US007342548B2

(12) United States Patent
Taniguchi et al.

(10) Patent No.: US 7,342,548 B2
(45) Date of Patent: Mar. 11, 2008

(54) RADIO GUIDANCE ANTENNA, DATA COMMUNICATION METHOD, AND NON-CONTACT DATA COMMUNICATION APPARATUS

(75) Inventors: Michiaki Taniguchi, Kyoto (JP); Toshiya Kitagawa, Kyoto (JP)

(73) Assignee: Omron Corporation (JP)

( * ) Notice: Subject to any disclaimer, the term of this patent is extended or adjusted under 35 U.S.C. 154(b) by 580 days.

(21) Appl. No.: 10/254,835

(22) Filed: Sep. 26, 2002

(65) Prior Publication Data

US 2003/0063034 A1 Apr. 3, 2003

(30) Foreign Application Priority Data

Sep. 28, 2001 (JP) ..... 2001-301401

(51) Int. Cl.
*H01Q 11/12* (2006.01)
*H01Q 21/00* (2006.01)

(52) U.S. Cl. ..... 343/742; 343/867; 340/572.7

(58) Field of Classification Search ..... 343/742, 343/867; 340/572.7
See application file for complete search history.

(56) References Cited

U.S. PATENT DOCUMENTS 4,260,990 A * 4/1981 Lichtblau ..... 343/742
4,679,046 A 7/1987 Curtis et al.
5,602,556 A * 2/1997 Bowers ..... 343/742
6,166,706 A * 12/2000 Gallagher et al. ..... 343/867
6,570,490 B1 * 5/2003 Saitoh et al.

FOREIGN PATENT DOCUMENTS

| | | |
|---|---|---|
| EP | 0440370 | 8/1991 |
| EP | 0663657 | 7/1995 |
| EP | 1128464 | 8/2001 |
| EP | 1123367 | 8/2002 |
| EP | 1467435 | 10/2004 |
| JP | 06 006271 | 1/1994 |
| JP | 09-098014 | 4/1997 |
| JP | 11-023682 | 1/1999 |
| JP | 11-272827 | 10/1999 |
| JP | 11-050343 | 9/2000 |

* cited by examiner

*Primary Examiner*—Michael C. Wimer
(74) *Attorney, Agent, or Firm*—Dickstein Shapiro LLP

(57) ABSTRACT

A radio guidance antenna in which the sum of mutual inductances of antennas is minimized. The radio guidance antenna includes a first antenna which is divided into upper and lower half regions by antenna conductors, and a second antenna which is composed of an antenna conductor and formed on the same plane as or a plane parallel to a plane of the first antenna. The second antenna is not connected to the first antenna at any points where it intersects the first antenna, but rather is inductively coupled to the upper and lower halves of the first antenna through mutual inductance regions. The first antenna is supplied with electric power from a first feeding point, and the second antenna is supplied with electric power from a second feeding point. The invention also includes a data communication method and a non-contact data communication apparatus which make use of the radio guidance antenna.

38 Claims, 22 Drawing Sheets

RIGHT OBLIQUE DIRECTION

RADIO GUIDANCE ANTENNA, DATA COMMUNICATION METHOD, AND NON-CONTACT DATA COMMUNICATION APPARATUS

BACKGROUND OF THE INVENTION

The invention relates to a radio guidance antenna, a data communication method, and a non-contact data communication apparatus, which make use of such antenna, and more particularly, to a radio guidance antenna for use in non-contact identification apparatus such as physical distribution systems, electronic coupon ticket systems, and the like, a data communication method, and a non-contact data communication apparatus, which make use of such antenna.

Conventionally, a system for identification and management of articles is needed in article identification apparatus such as assembly and conveyance lines and physical distribution systems, and electronic coupon ticket systems.

FIG. 21 is a view showing the schematic constitution in such system. As shown in FIG. 21, data carriers (referred below to as tags) 201, 202 of a non-contact identification apparatus are fabricated in a card-shape and a coin-shape to contain therein printed coils 203, 204 and IC chips 205, 206. These tags 201, 202 are attached to commodities 207 to be managed, and data are transmitted and received in a non-contact manner as the commodities are passed through antenna gates 208, 209. Thus, the tags are used as a tool of merchandise management and conveyance history management in the field of physical distribution, security and so on.

Radio guidance antennas are housed in the antenna gates 208, 209 of the non-contact identification apparatus shown in FIG. 21. The most important point required for such radio guidance antennas is to ensure the magnetic-field intensity necessary for communication in all locations in a read area. Communication between a read and write device of the non-contact identification apparatus and the tags 201, 202 makes use of mutual inductance coupling between antennas for transmission and reception and loop antennas 203, 204 formed in the tags 201, 202.

Induced electromotive forces generated in the loop antennas 203, 204 of the tags 201, 202 can be represented by—M (di/dt) where M indicates mutual inductance between the antennas for transmission and reception and the loop antennas 203, 204 in the tags 201, 202 and i indicates electric current generated in the antennas for transmission. This means that in order to ensure a predetermined magnetic-field intensity when i=constant, mutual inductance M of at least a predetermined value must be generated. That is, in the case of M=0, electric power is not supplied to the tags 201, 202 however great the current through the read antennas may be, and so communication between the read and write antennas and the tags 201, 202 becomes impossible.

With conventional antennas, which are in many cases disposed on a single plane, however, regions where M=0 or M is very small are always present in read and write regions.

FIG. 22 shows mutual inductance between loop antennas of one winding. In FIG. 22, lines of magnetic flux emitted from a transmission antenna 220 are indicated by solid lines with arrows, and it is shown that the more lines of magnetic flux per unit area, the larger magnetic flux density. Also, the magnetic flux density, at which magnetic flux generated by current through the transmission antenna 220 passes through an antenna loop of a tag, is in proportion to M between the read and write antenna and an antenna of the tag. Accordingly, it is shown that the more the number of lines of magnetic flux passing through the loop of the tag, the larger the mutual inductance M.

A tag 211 shown in FIG. 22 is disposed on the same axis as that of the transmission antenna 220, so that a transmission antenna loop and a loop of the tag are in parallel to each other. In the case of such positional relationship, it is shown that the number of interlinkages of lines of magnetic flux generated by the transmission antenna 220 is large and the mutual inductance M is large. In contrast, in the case where a tag 212 is disposed so that a loop of the transmission antenna 220 and a loop of the tag are perpendicular to each other, the lines of interlinking magnetic flux become 0, that is M=0.

FIG. 22 also shows a tag 213 which is parallel to the transmission antenna 220 but disposed in a position offset from a surface of projection of the transmission antenna 220 in an axial direction. In this case, the number of lines of magnetic flux making interlinkage with the tag 213 is very small and the mutual inductance M becomes small. In the case of an antenna system with the transmission antenna 220 and only one feeding point, a region or regions where the mutual inductance M is 0 or very small are always present depending upon the position and direction of a tag. Accordingly, when such arrangement is used in an antenna system, in which a tag is not limited in orientation and a predetermined mutual inductance M is generated in a large area, it has been naturally necessary to increase the number of antennas and feeding points.

FIG. 23 shows mutual inductance between loop antennas when there are provided two transmission antennas. Like the case in FIG. 22, a magnetic field radiated from a transmission antenna 221 provided in addition to the transmission antenna 220 is represented by lines of magnetic flux indicated by broken lines with arrows. In the case where the two transmission antennas 220, 221 are installed, lines of magnetic flux generated by the transmission antenna 221 pass through tags 212, 213. However, the mutual inductance M between tags 212, 213 and the transmission antenna 220 is not adequate. Thus, the mutual inductance M is generated between the tags and the transmission antenna 221. Accordingly, the more the number of antennas, the more complex the magnetic field, so that there is an increased probability that communication will be enabled irrespective of directions and positions of tags.

However, the above-mentioned measure involves a significant problem. As shown in FIG. 23, many lines of magnetic flux make interlinkage with the transmission antennas 220, 221 and thus the mutual inductance M between the transmission antennas is shown as being increased. That is, a part of electric power supplied to the transmission antenna 220 is also supplied to the transmission antenna 221 due to mutual induction, so that all of the electric power supplied to the transmission antenna 220 is not supplied as an antenna current to the transmission antenna 220. Instead, a part of the electric power supplied to transmission antenna 220 disadvantageously increases the remote electromagnetic-field intensity from the transmission antenna 221.

In this manner, it is very difficult to arrange a plurality of antennas in an overlapping manner and control them independently. Because of this, in the case of using a plurality of antennas, the antennas are conventionally arranged with particular distances therebetween so that mutual inductance between the antennas becomes small, but it becomes difficult to assure the stability of read and write regions.

One way to solve the above-described problem is with a three-dimensionally perpendicular arrangement of antennas as described in Japanese Laid-Open Patent Application No. 2000-251030. However, antennas of such construction have been too complex and expensive to be practical.

BRIEF SUMMARY OF THE INVENTION

Therefore, a primary object of the invention is to provide a radio guidance antenna in which the sum of mutual inductances of antennas is small and which is inexpensive and excellent in quality of communication, a data communication method, and a non-contact data communication apparatus which makes use of the antenna.

The invention provides a radio guidance antenna comprising at least first and second antennas, which are different in electric supply method, and wherein the first antenna has at least two regions for generating lines of magnetic flux in reciprocal directions, and the second antenna has first and second mutual inductances for generating induced electromotive forces in opposite directions due to an action of electromagnetic induction from the first antenna, the second antenna being arranged so that the sum of mutual inductances between it and the first antenna is decreased.

The coupling of the antennas is composed of inductive coupling with a slight mutual induction and electrostatic coupling, so that even when the antennas are arranged on parallel planes and a state of feeding electricity to a certain antenna is changed with time, it is possible to decrease influences on another antenna. That is, since electric power as supplied can be efficiently converted to electromagnetic field with a simple construction and a remote electromagnetic-field intensity can also be suppressed to be small, it is possible to realize a radio guidance antenna which is small, lightweight and excellent in quality of communication.

Also, the invention has a feature in that the difference in value between the first and second mutual inductances is equal to or less than one half of the self inductance of the first antenna. Also, the invention has a feature in that the difference in value between the first and second mutual inductances is equal to or less than one third of the self inductance of the first antenna. Further, the invention has a feature in that the first antenna comprises two or more antennas.

Further, the invention has a feature in that the first and second antennas include feeding points provided in different positions, respectively. Further, the invention has a feature in that the first antenna is formed in a substantially figure eight-shape in order to generate lines of magnetic flux in reciprocal directions. Also, the invention has a feature in that the second antenna is formed in a substantially figure eight-shape and arranged in a position turned 90 degrees relative to the first antenna.

Another invention provides a method for data communication with a tag in non-contact manner with electromagnetic induction, the method comprising providing a radio guidance antenna including a first antenna having at least two regions for generating lines of magnetic flux in reciprocal directions, and a second antenna having first and second mutual inductances for generating induced electromotive forces in opposite directions due to an action of electromagnetic induction from the first antenna, the second antenna being arranged so that the sum of mutual inductances between it and the first antenna is decreased, and sending data to the tag from one of the first and second antennas with electromagnetic induction, and causing the other of the first and second antennas to receive data sent from the tag with electromagnetic induction.

A further invention provides a non-contact data communication apparatus for data communication with a tag in non-contact manner with electromagnetic induction, the apparatus comprising a radio guidance antenna including a first antenna having at least two regions for generating lines of magnetic flux in reciprocal directions, and a second antenna having first and second mutual inductances for generating induced electromotive forces in opposite directions due to an action of electromagnetic induction from the first antenna, the second antenna being arranged so that the sum of mutual inductances between it and the first antenna is decreased, and transmission means for sending data to the tag from either of the first and second antennas with electromagnetic induction.

A still further invention provides a non-contact data communication apparatus for data communication with a tag in non-contact manner with electromagnetic induction, the apparatus comprising a radio guidance antenna including a first antenna having at least two regions for generating lines of magnetic flux in reciprocal directions, and a second antenna having first and second mutual inductances for generating induced electromotive forces in opposite directions due to an action of electromagnetic induction from the first antenna, the second antenna being arranged so that the sum of mutual inductances between it and the first antenna is decreased, and receiver means for receiving data sent from the tag to either of the first and second antennas with electromagnetic induction.

According to these inventions, electric power as supplied can be efficiently converted to electromagnetic field with a radio guidance antenna for transmission and reception, and data communication is enabled in a communication area in non-contact manner even when a tag is oriented in any direction. Also, in these inventions, the radio guidance antenna is arranged on a substrate and the transmission means or receiver means is arranged on the substrate. Thereby, it is possible to make a data communication apparatus which is small-sized, lightweight and high in performance.

DETAILED DESCRIPTION OF THE INVENTION

Figure 1:
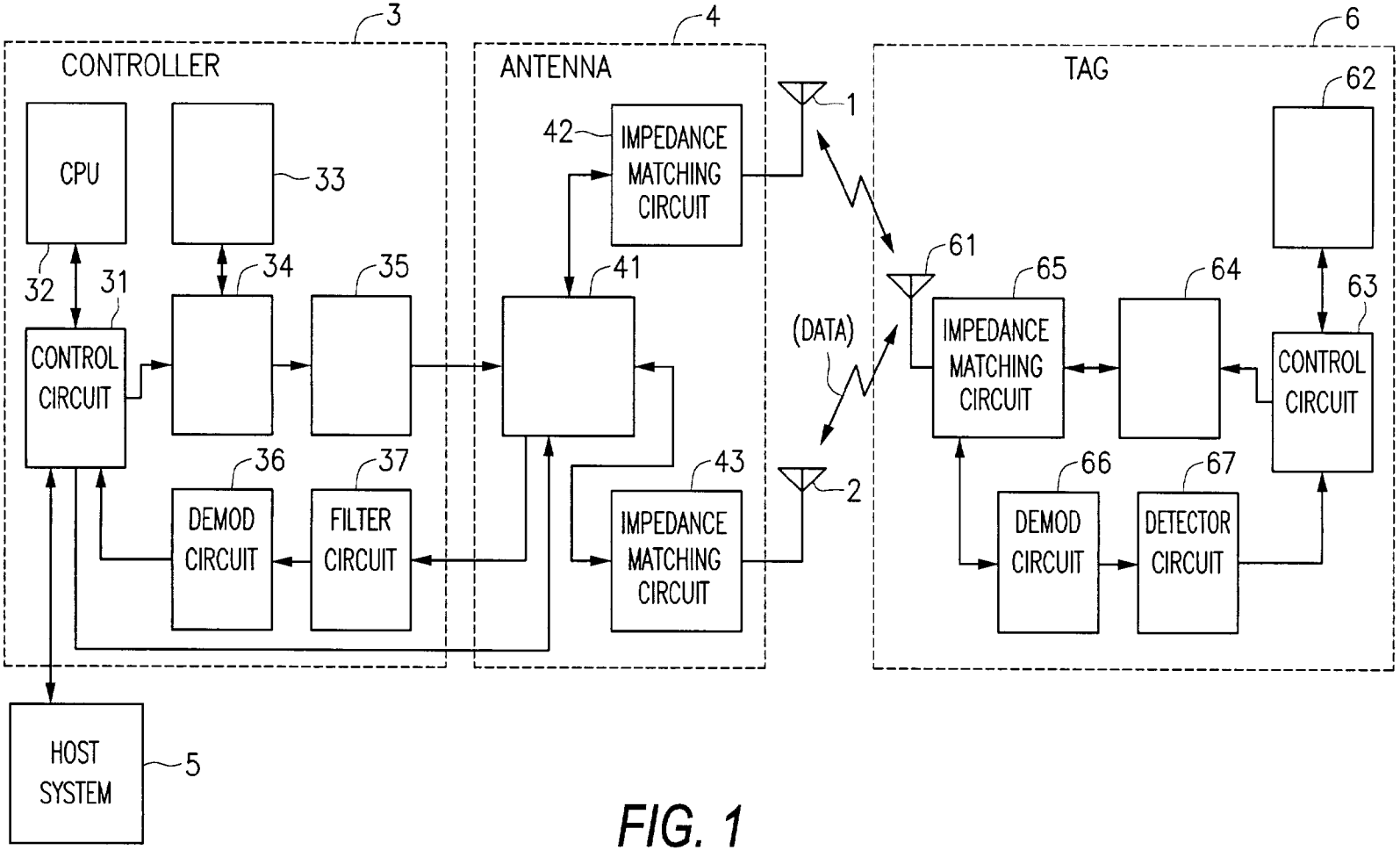
FIG. 1 is a block diagram showing a system configuration according to an embodiment of the invention.

FIG. 1 is a block diagram showing a system configuration according to an embodiment of the invention. The system configuration shown in FIG. 1 is shown as a preferred embodiment adopting an amplitude modulation with a power circuit removed.

In FIG. 1, a non-contact identification apparatus is composed of a first antenna 1, a second antenna 2, a controller 3, and an antenna peripheral circuit 4. The controller 3 mainly functions as an interrogator for reading and writing data into a storage circuit 62 of a tag 6. Thus the controller 3 includes a control circuit 31, a CPU 32, a carrier wave generating circuit 33, a modulation circuit 34, an amplifier circuit 35, a demodulator circuit 36, and a filter circuit 37. Also, the antenna peripheral circuit 4 includes an antenna select circuit 41 and impedance matching circuits 42, 43, the antenna 1 being connected to the impedance matching circuit 42, and the antenna 2 being connected to the impedance matching circuit 43.

The controller 3 is connected to a host system 5, and coded data from a storage device of the CPU 32 are given to the modulation circuit 34 via the control circuit 31. The modulation circuit 34 mixes carrier waves output by the carrier wave generating circuit 33 and superimposes data on the waves, and the modulated carrier waves thus mixed are amplified by the amplifier circuit 35 to be fed to the antenna 1 or 2 via the impedance matching circuit 42 or 43 from the antenna select circuit 41. Then the waves are discharged into the air as an electromagnetic field from the selected antenna 1 or 2.

Meanwhile, the tag 6 includes an antenna 61 composed of a printed coil, the storage circuit 62, a control circuit 63, a modulation circuit 64, an impedance matching circuit 65, a demodulator circuit 66, and a detector circuit 67. Not all tags are provided with the impedance matching circuit 65. An electromagnetic field emitted from the antenna 1 or 2 of the non-contact identification apparatus generates an induced electromotive force in the antenna 61 of the tag 6 to provide electric power required for the tag. At the same time, the induced electromotive force generated in the antenna 61 is passed to the demodulator circuit 66 via the impedance matching circuit 65, the carrier waves are removed by the demodulator circuit 66, the signal is decoded by the detector circuit 67, and the decoded data is sent to the control circuit 63. The control circuit 63 stores the data in the storage circuit 62.

Subsequently, when data are to be read from the tag 6, the controller 3 sends a read command to the control circuit 63 of the tag 6. The control circuit 63 of the tag 6 reads the data from a region of the storage circuit 62 indicated by the controller 3 and changes the impedance of the antenna 61 with the modulation circuit 64 of the tag 6. The antenna 61 of the tag 6 and the antenna 1 or 2 of the non-contact identification apparatus are coupled to each other via mutual inductance, so that when the impedance of the antenna 61 of the tag 6 is changed, the antenna impedance on the side of the non-contact identification apparatus changes. Thus, voltage input into the demodulator circuit 36 from the antenna peripheral circuit 4 through the filter circuit 37 also changes. The carrier waves are removed by the demodulator circuit 36, the signal is decoded, and the resultant data is written into the storage device of the CPU 32 by the control circuit 31.

In this manner, data communication is accomplished by repeating reading and writing of data between the tag 6 and the non-contact identification apparatus. An explanation has been given by way of example with respect to the amplitude modulation system but the present invention is not limited thereto.

Figure 2:
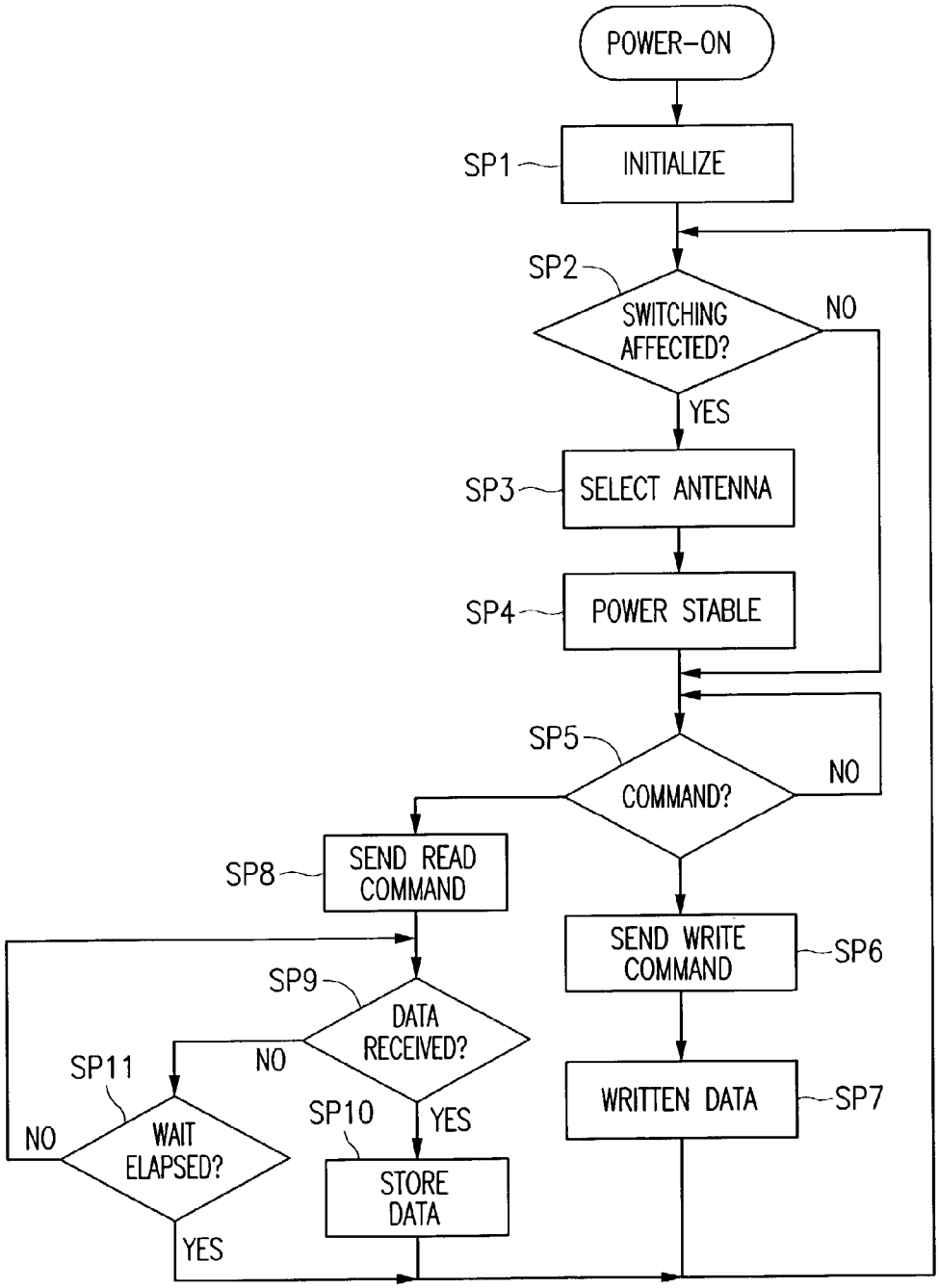
FIG. 2 is a flowchart showing the processing procedure in a CPU of a controller 3 shown in FIG. 1.

FIG. 2 is a flowchart showing the processing procedure in the CPU of the controller 3 shown in FIG. 1. In FIG. 2, the CPU 32 is initialized in STEP (denoted by SP by abbreviation in the figure) SP1 after power-ON, it is determined in STEP SP2 whether antenna switching should be effected or not, and a predetermined antenna is put in a selected state in STEP SP3 in the case of a command for antenna switching. The procedure stands ready in STEP SP4 until electric power becomes stable. Thus the procedure stands ready for a predetermined time until electric power supplied via electromagnetic coupling becomes stable on a side of the tag 6.

The CPU 32 discriminates between a write command and a read command in STEP SP5 on the basis of a command received from the host system 5. In the case of a write command, a write command is sent in STEP SP6, and written data are sent in STEP SP7. In the case of a read command, a read command is sent in STEP SP8, and it is determined in STEP SP9 whether read data has been received or not, so that when read data have been received, the read data are written into the storage device in the CPU 32 in STEP SP10. If the read data have not yet been received, it is determined in STEP SP11 whether or not a read wait time has elapsed, and STEP SP9 and STEP SP11 are repeated until the read wait time elapses. If the read wait time has elapsed, the procedure proceeds to STEP SP2.

In this manner, reading and writing of data is carried out between the non-contact identification apparatus and the tag 6.

Figure 3:
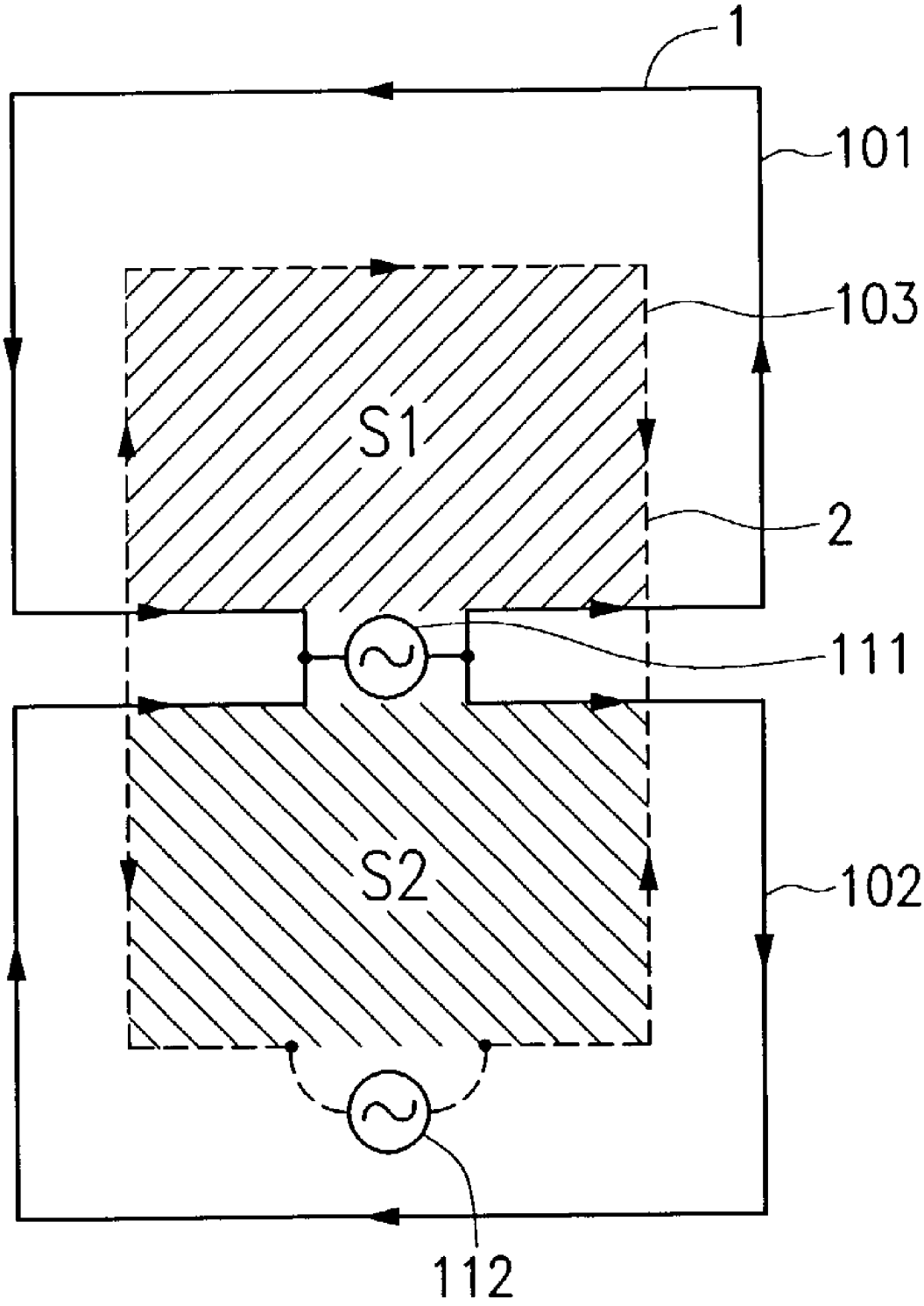
FIG. 3 is a view showing a preferred embodiment of antennas 1, 2 shown in FIG. 1.

FIG. 3 is a view showing a preferred embodiment of the antennas 1 and 2 shown in FIG. 1. In FIG. 3, the first antenna 1 is provided by forming antenna conductors 101, 102 in a substantially figure eight shape, which reduces a remote electromagnetic-field effect. The first antenna 1 is divided into upper and lower halves by the antenna conductors 101, 102. Meanwhile, the second antenna 2 is composed of an antenna conductor 103 formed on the same plane as or a plane parallel to the plane on which the first antenna 1 is formed, but is not connected to the first antenna 1 at any point. The second antenna 2 is coupled in electromagnetic induction to the upper and lower halves of the first antenna 1 via regions S1, S2.

The first antenna 1 is supplied with electric power from a first feeding point 111, and an increase in antenna current for the first antenna 1 is observed. Arrows shown on the antenna 1 indicate a direction of antenna current observed at a certain point of time. Also, the second antenna 2 is supplied with electric power from a second feeding point 112. Arrows shown on the antenna 2 indicate directions of induced electromotive forces caused by mutual inductance between it and the antenna 1 as directions of induced electric power. This electric power is caused by the flowing of the induced electromotive forces described above.

As shown in FIG. 3, the directions of induced electromotive forces generated on the antenna 2 are such that induced current is caused to flow in the regions S1, S2 in opposite directions. That is, induced electromotive forces generated in the regions S1, S2, respectively, are generated in the direction in which the forces cancel each other. Here, in particular, in the case of S1/S2=1 (S1=S2), the induced electromotive force generated on the antenna 2 as a whole becomes zero. That is, residual mutual inductances of the antenna 1 and the antenna 2 are put in a state of zero.

Likewise, in the case where the antenna 2 is supplied with electric power from the second feeding point 112, the mutual inductance regions S1, S2 overlap each other and so induced electromotive forces are generated on the antenna 1. In particular, in the case of S1=S2, the residual mutual inductance becomes zero, so that any induced electromotive force is not generated on the antenna 1. This means that electric power as supplied is not taken by another antenna, antenna current is not generated by electric power supplied to another antenna, and the system is equivalent to one provided with feeding points and antennas in two independent systems.

More specifically, even when one of the antennas is varied in impedance and a power feeding state, the other antenna is influenced thereby not to be varied in impedance and antenna current. In this way, electric power supplied to the antennas can be converted to an electromagnetic field with high efficiency and a plurality of antennas can be installed, while the remote electromagnetic-field intensity is also controlled at an exceedingly low level.

An explanation will now be given of the relationship between self inductance and mutual inductance of the radio guidance antenna according to the invention. Assuming that self inductance generated on the antenna conductors 101, 102 of the antenna 1 is $L_1$ and the difference ($|M_1-M_2|$) between a first mutual inductance $M_1$ and a second mutual inductance $M_2$, which generate opposite induced electromotive forces on the antenna 2 with electromagnetic induction from the antenna 1 is a residual mutual inductance $M_r$, an equivalent inductance of the antenna 1 is represented by $L_1-M_r$, and so in the case of $M_r=(L_1/2)$, the equivalent inductance of the antenna 1 will become $L_1/2$. That is, since the equivalent inductance of the antenna 1 is equal to the residual mutual inductance, the signal electric power supplied to the antenna 1 becomes equal to a signal induced electromotive force generated on the antenna 2 under electromagnetic induction from the antenna 1.

Also, when $M_r>(L_1/2)$, half or more of the signal electric power supplied to the antenna 1 is induced to the antenna 2, so that the electromagnetic field generated from the antenna 1 is sharply decreased, and the electromagnetic field emitted from the antenna 2 stands out conspicuously as a remote electromagnetic-field intensity, so that the non-contact identification apparatus of the present invention can no longer function as a transmission and reception antenna. Taking these into consideration, a residual mutual inductance $M_r=0$ is most preferable, while by making the residual inductance $M_r$ equal to or less than a half of the self inductance of the antenna 1, the antenna can be made an antenna which efficiently generates an electromagnetic field and suppresses a remote electromagnetic-field intensity.

Also, more preferably, by making the residual mutual inductance $M_r$ equal to or less than one third of the self inductance $L_1$ of the antenna 1, the signal electric power supplied to the antenna 1 becomes twice the signal electric power induced to the antenna 2, thus making the antenna more efficient.

Figure 4:
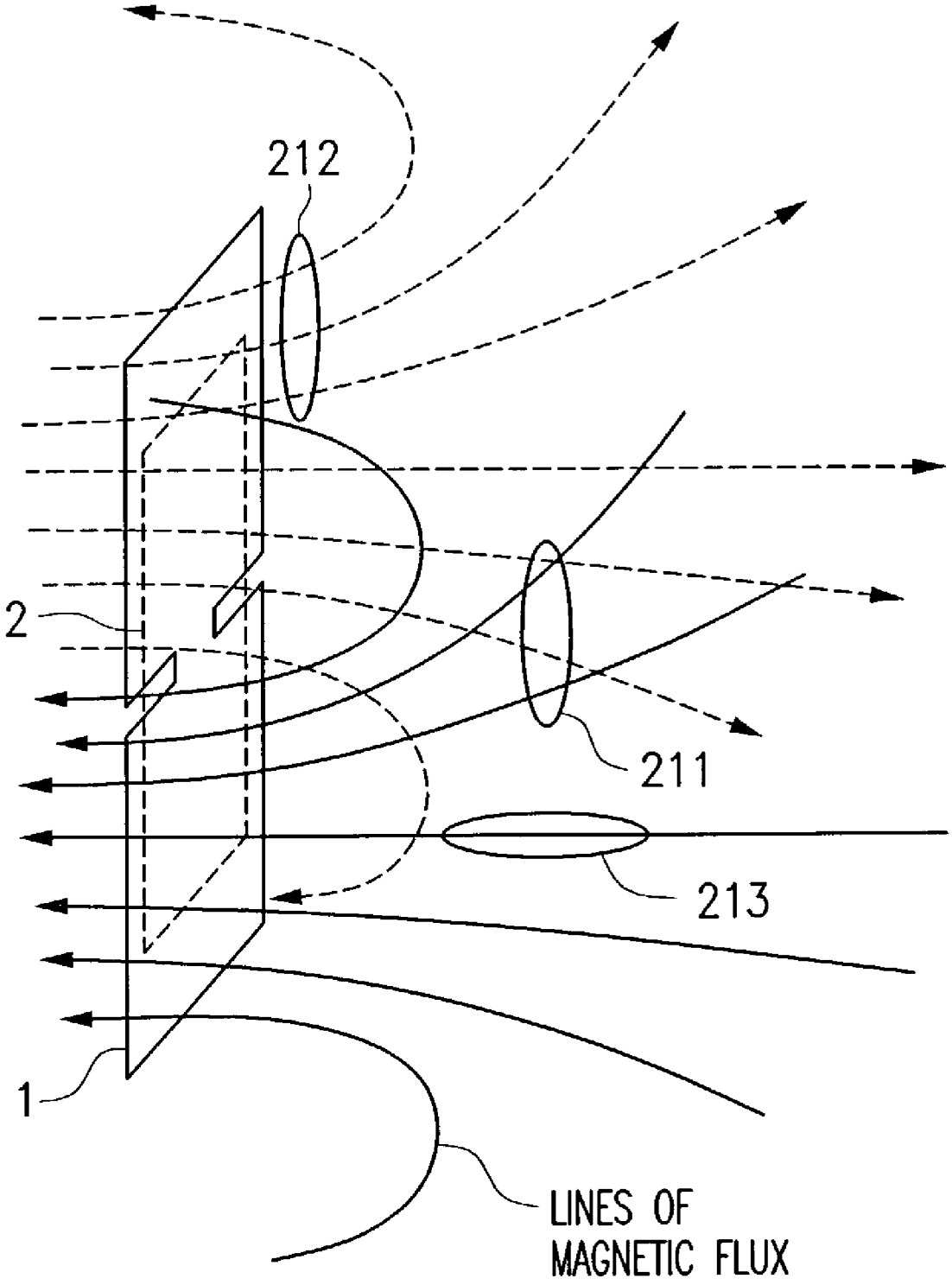
FIG. 4 is a view showing only lines of magnetic flux generated from the antenna 1 shown in FIG. 3 at a certain point of time.
Figure 5:
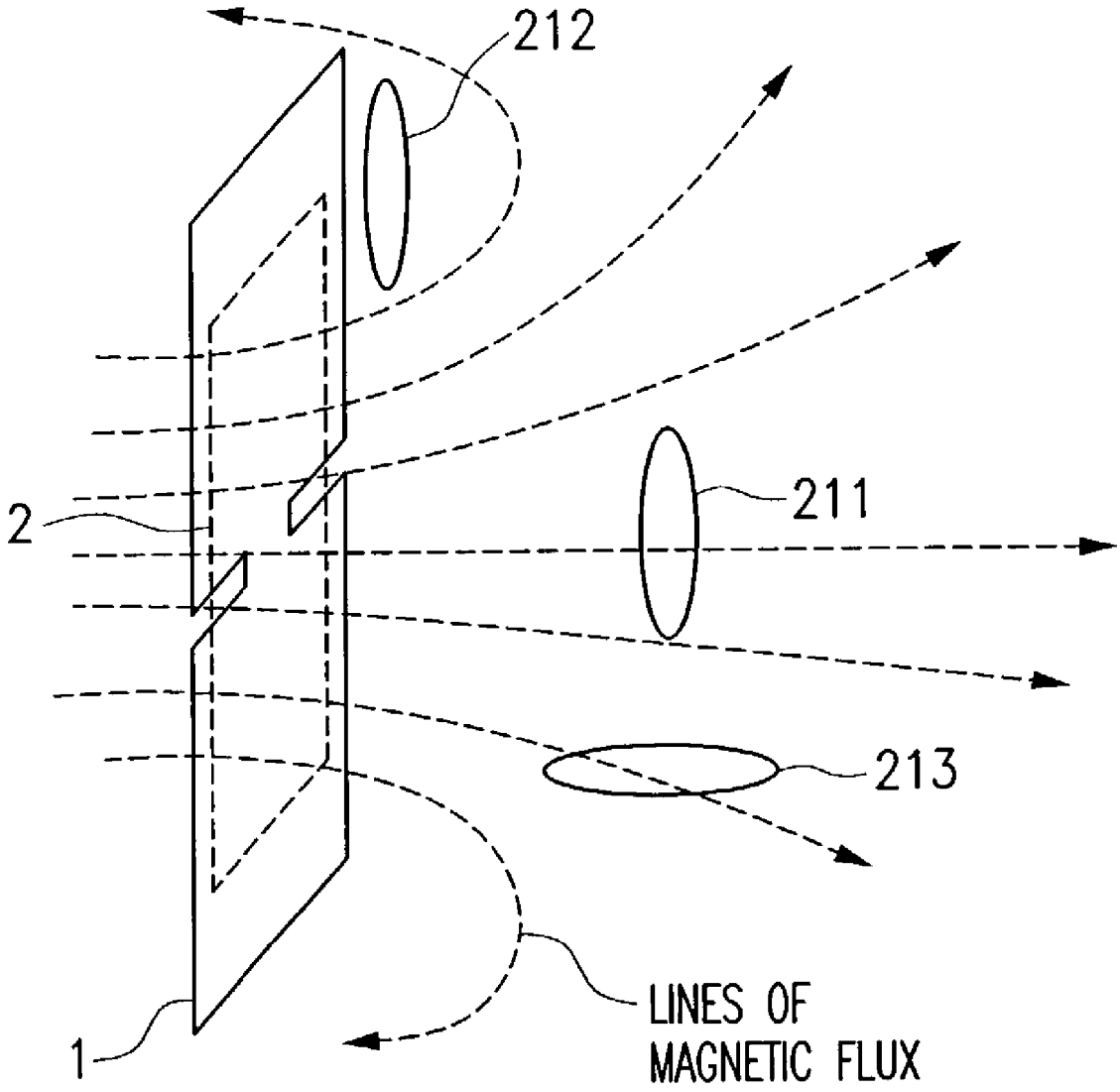
FIG. 5 is a view showing only lines of magnetic flux generated from the antenna 2 shown in FIG. 3 at a certain point of time.

FIGS. 4 and 5 show the appearance of a magnetic field caused by the antenna shown in FIG. 3 when the antenna is in communication with the tag. In particular, FIG. 4 shows only lines of magnetic flux generated from the antenna 1 (shown in FIG. 3) at a certain point of time, and FIG. 5 shows only lines of magnetic flux generated from the antenna 2 (shown in FIG. 3) at a certain point of time.

In FIG. 4, lines of magnetic flux indicated by solid lines are ones generated from a lower loop among two upper and lower loops of the antenna 1, and lines of magnetic flux indicated by broken lines are ones generated from the upper loop. The lines of magnetic flux indicated by solid lines and the lines of magnetic flux indicated by broken lines, which are substantially the same in number, make interlinkage with a tag 211, and the lines of magnetic flux indicated by solid lines and the lines of magnetic flux indicated by broken lines, which make such interlinkage, are equal in magnitude to each other and directed opposite to each other all the time. Therefore, the induced electromotive force generated on the tag 211 becomes substantially zero and so the tag 211 has difficulty remaining in continual communication with the antenna 1. Also, a second tag 213 is positioned to be perpendicular to the lower loop, and so no lines of magnetic flux indicated by solid lines make interlinkage with this tag. Only lines of magnetic flux indicated by broken lines and having an exceedingly small intensity (not shown) male interlinkage with the tag 213 difficult, which in turn impedes communication. A third tag 212 makes interlinkage with many lines of magnetic flux indicated by broken lines and is shown as being in a state in which it can favorably make communication with the antenna 1.

FIG. 5 shows a state in which many lines of magnetic flux make interlinkage with the tag 211 and the tag 213 which have difficulty communicating with the antenna 1, but favorably communicate with the antenna 2. Meanwhile, lines of magnetic flux making interlinkage with the tag 212 which has been put in a state of favorable communication with the antenna 1 are exceedingly weak and have difficulty in communication.

Figure 6E:
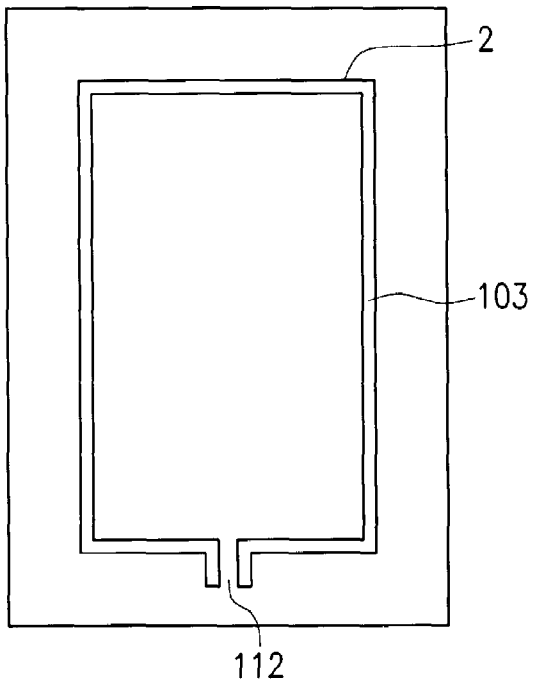
FIGS. 6A to 6E are views showing a preferable construction of the antenna shown in FIG. 3.
Figure 6D:
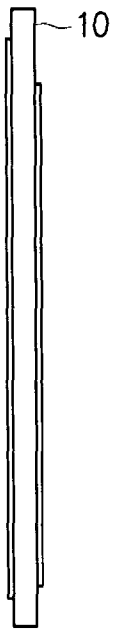
Figure 6A:
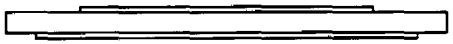
Figure 6B:
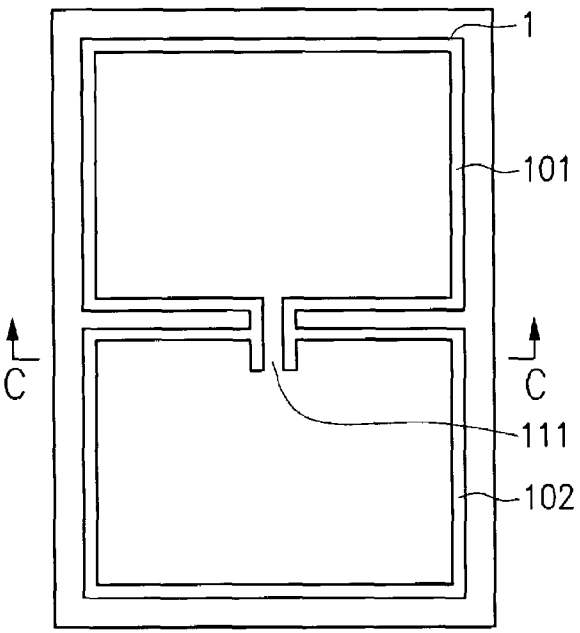
Figure 6C:
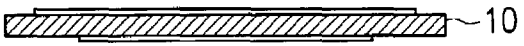

FIGS. 6A to 6E are views showing a preferable construction of the antenna shown in FIG. 3, specifically, FIG. 6A being a plan view, FIG. 6B being a front view, FIG. 6C being a cross sectional view taken along the line C-C in FIG. 6B, FIG. 6D being a side elevational view, and FIG. 6E being a rear view.

In FIGS. 6A to 6E, thin band-shaped antenna conductors 101, 102 are disposed on one of main surfaces of a plate-shaped insulation 10 in a rectangular configuration to form an antenna 1, and a feeding point 111 is provided at a connection of the antenna conductors 101, 102. A thin band-shaped antenna conductor 103 is disposed on the other of the main surfaces of the insulation 10 in a rectangular configuration to form an antenna 2, and a feeding point 112 is provided in a lower portion of the antenna.

As examples of the insulation 10, it is possible to adopt printed-circuit boards, general purpose plastic and the like. Also, examples of the antenna conductors 101, 102 may include metallic plates of copper, aluminum, brass and so on, and copper foil for use in printed-circuit boards.

Figure 7A:
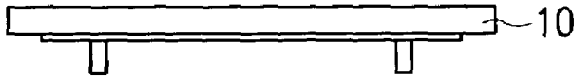
FIGS. 7A to 7D are views showing another construction of the antenna shown in FIG. 3.
Figure 7B:
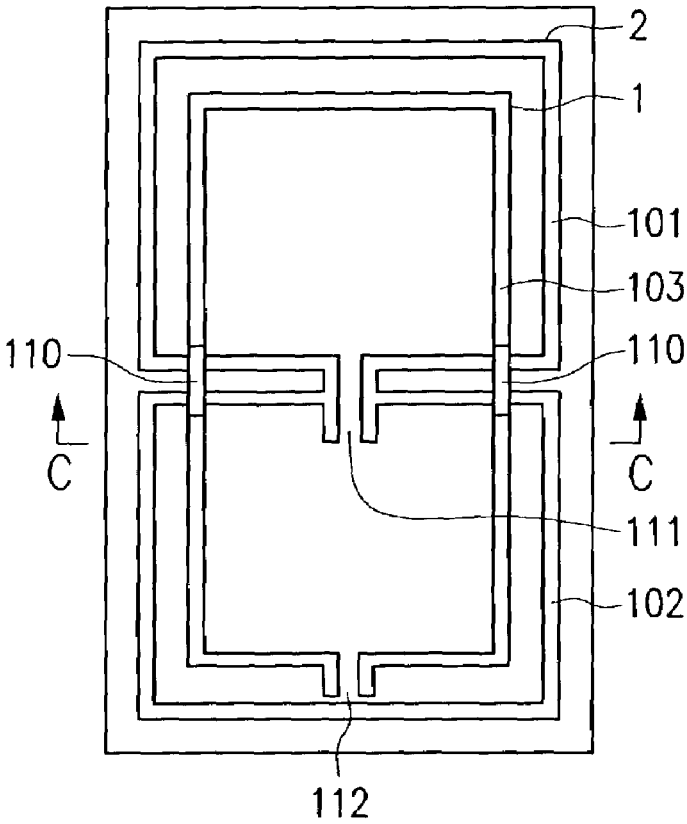
Figure 7D:
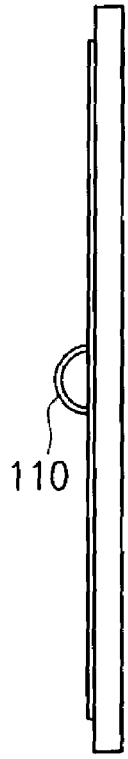
Figure 7C:
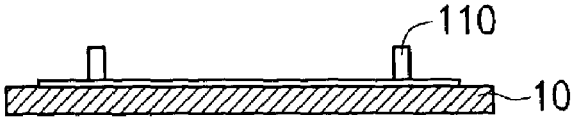

FIGS. 7A to 7D are structural views showing another construction of the antennas 1 and 2. Specifically, FIG. 7A is a plan view, FIG. 7B is a front view, FIG. 7C is a cross sectional view taken along the line C-C in FIG. 7B, while FIG. 7D is a side elevational view.

In FIGS. 7A to 7D, antennas 1 and 2 are arranged on either of same planes of an insulation 10, and two-level crossings 110 are provided to insulate locations where antenna conductors 101, 102 of the antenna 1 and an antenna conductor 103 of the antenna 2 intersect each other. With such an arrangement, the antenna 1 and the antenna 2 can be made equal in distance from a tag as compared with the arrangement shown in FIGS. 6A to 6E. The arrangement shown in FIGS. 7A to 7D is effective in the case where either of the antenna 1 and the antenna 2 is more distant from the tag, so that stability in communication is hard to achieve.

Figure 8A:
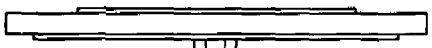
FIGS. 8A to 8E are views showing another modification of the antenna shown in FIG. 3.
Figure 8B:
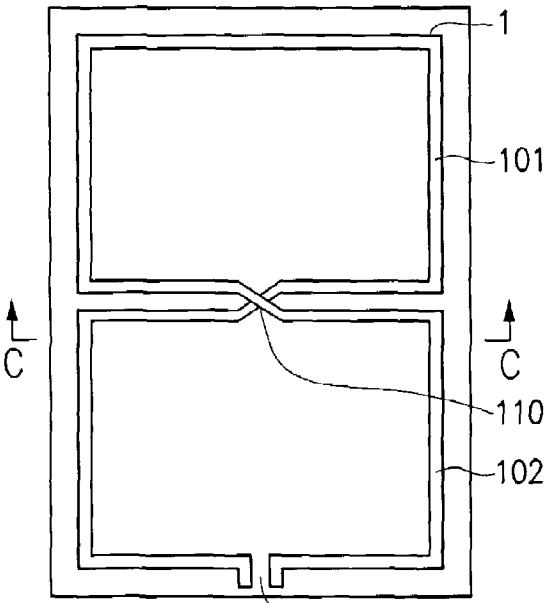
Figure 8D:
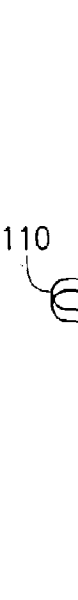
Figure 8E:
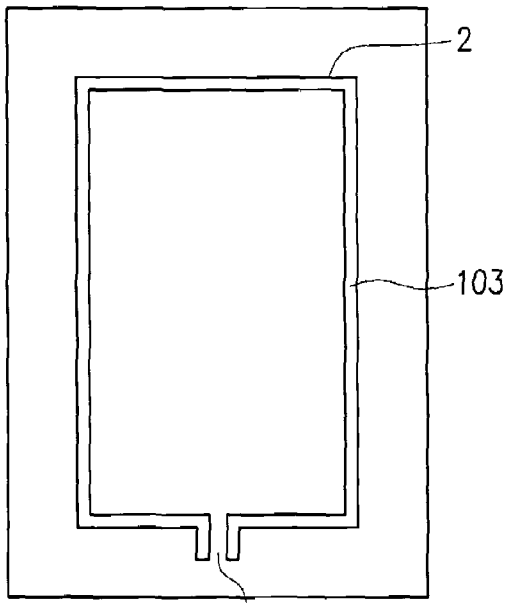
Figure 8C:
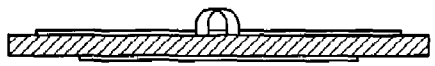

FIGS. 8A to 8E are views showing another modification of the antenna shown in FIG. 3 Specifically, FIG. 8A is a plan view, FIG. 8B is a front view, FIG. 8C is a cross sectional view taken along the line C-C in FIG. 8B, while FIG. 8D is a side elevational view, and FIG. 8E is a rear view.

The examples shown in FIGS. 8A to 8E are substantially the same in antenna configuration as that shown in FIG. 3 except that a first feeding point 111 and a second feeding point 112 are disposed on a lower side of an insulation 10. With such an arrangement, the two feeding points 111, 112 are nearer to each other, which is favorable in wiring. That is, such arrangement is realized by two-level crossing centers of the antenna 1 having a substantially figure eight-shaped region, thereby forming two regions which generate repulsive lines of magnetic flux on the antenna 1.

Figure 9:
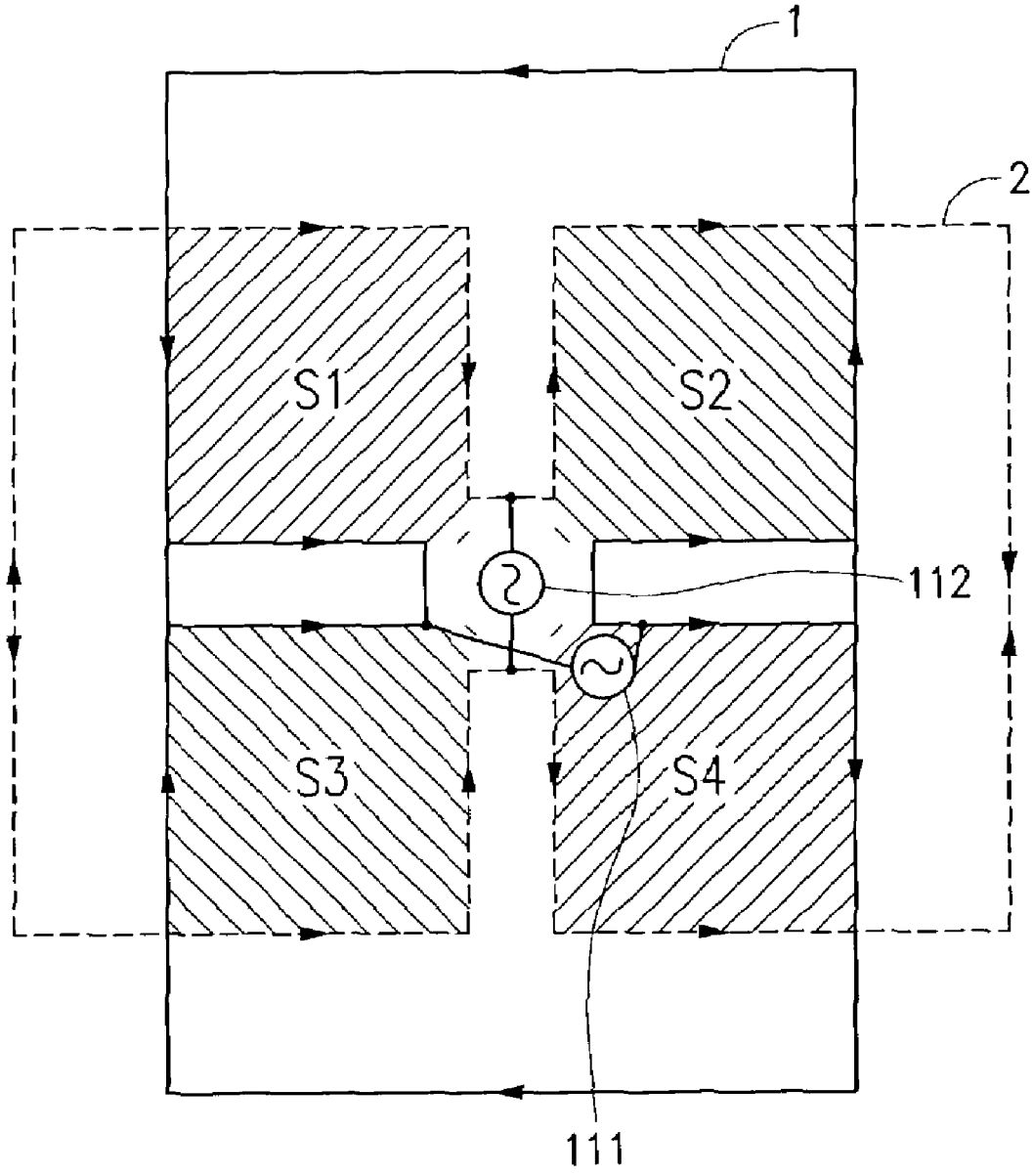
FIG. 9 is a view showing an antenna configuration according to a further embodiment of the invention.

FIG. 9 is a view showing an antenna configuration according to a further embodiment of the invention. In FIG. 9, an antenna 1 is substantially figure eight-shaped in the same manner as that shown in FIG. 3, and an antenna 2 is turned 90° relative to the antenna 1. In this case, an explanation will be given to the case where the antenna 1 is supplied with electricity, in the same manner as that shown in FIG. 3.

The antenna 1 and the antenna 2 overlap each other in regions S1, S2, S3 and S4. If an increase in antenna current in directions shown by arrows is observed in the antenna 1, then mutual inductances attributable to the regions S1 to S4 generate induced electromotive forces in the antenna 2 tending to make antenna current flow in directions shown by arrows, respectively. Directions of the induced electromotive forces are such that the regions S1, S2 generate an electromotive force in the antenna 2 tending to make antenna current flow in the same direction and the induced electromotive force attributable to the regions S3, S4 is opposite to the induced electromotive force attributable to the regions S1, S2.

Accordingly, in the case of S1+S2=S3+S4, the residual mutual inductance becomes zero and so the induced electromotive force generated on the antenna 2 by the antenna 1 becomes apparently zero. In like manner, the induced electromotive force generated on the antenna 1 when the antenna 2 is supplied with electricity becomes the same as above.

Figure 10A:
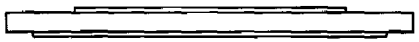
FIGS. 10A to 10E are views showing a more concrete structure of the antenna shown in FIG. 9.
Figure 10B:
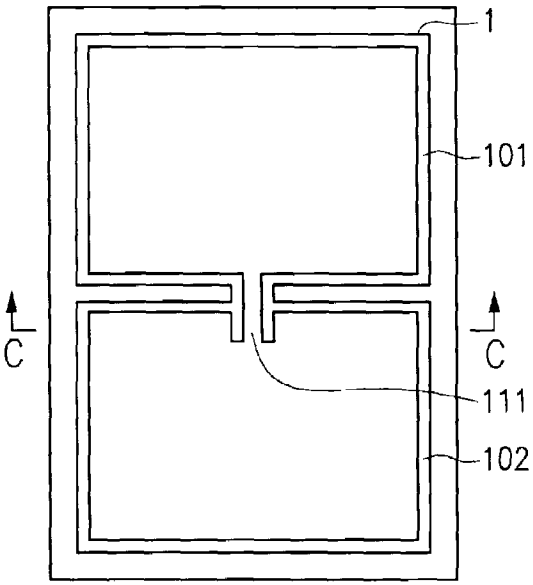
Figure 10C:
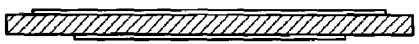
Figure 10D:
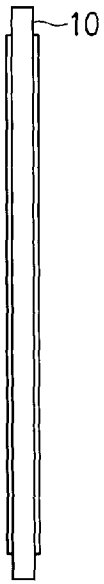
Figure 10E:
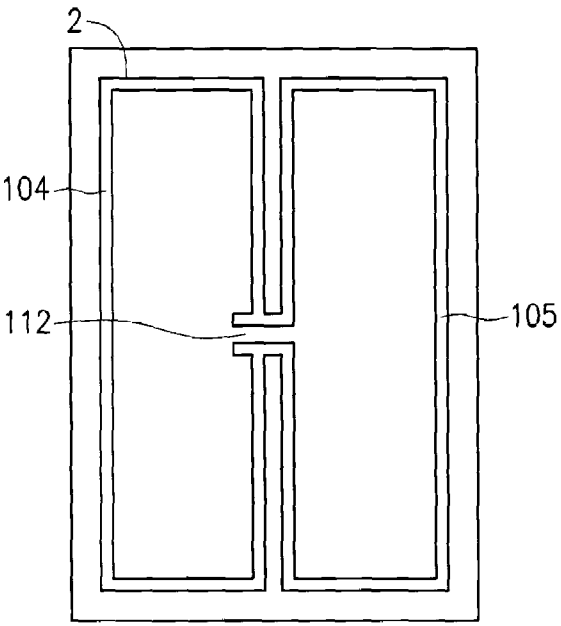

FIGS. 10A to 10E are views showing a more concrete structure of the antenna shown in FIG. 9. Specifically, FIG. 10A is a plan view, FIG. 10B is a front view, FIG. 10C is a cross sectional view taken along the line C-C in FIG. 10B, FIG. 10D is a side elevational view, and FIG. 10E is a rear view.

In FIGS. 10A to 10E, antenna conductors 101, 102 are used to form an antenna 1 on one of main surfaces of an insulation 10 in a substantially figure eight-shaped configuration, and antenna conductors 104, 105 are used to form an antenna 2 on the other of the main surfaces of the insulation 10 in a substantially figure eight-shaped configuration, the antenna 2 being turned 90° relative to the antenna 1.

Figure 11A:
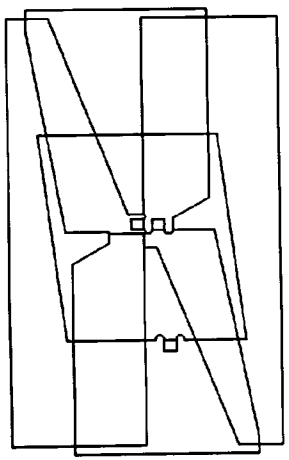
FIGS. 11A to 11D are views showing applications of a radio guidance antenna according to the invention.
Figure 11B:
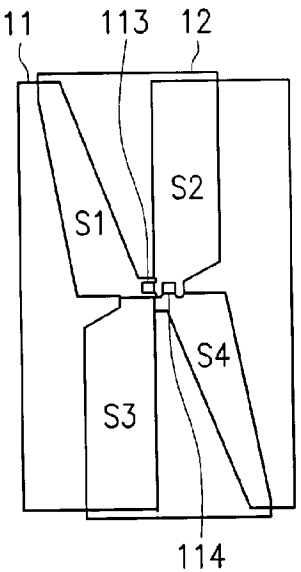
Figure 11C:
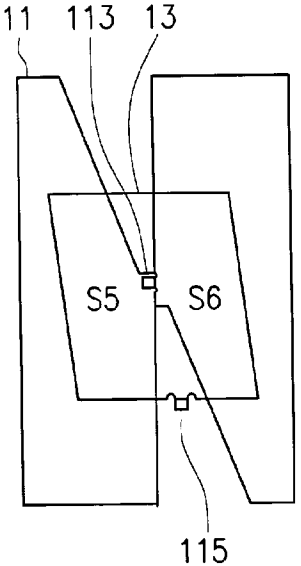
Figure 11D:
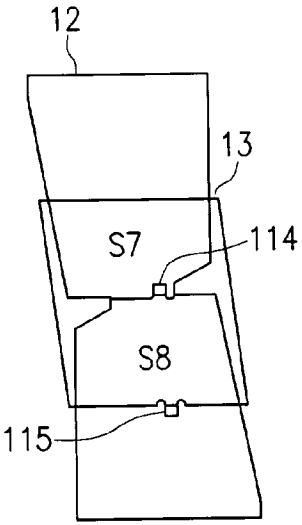

FIGS. 11A to 11D are views showing applications of the radio guidance antenna according to the invention, in which the arrangement shown in FIG. 3 and the arrangement shown in FIG. 9 are combined with each other. Respective antennas are composed of three sets of antennas 11, 12, 13 having different feeding points and separated from one another. More specifically, FIG. 11A shows the three sets of antennas as a whole, FIG. 11B showing only the antennas 11, 12, FIG. 11C showing the antennas 11, 13, and FIG. 11D showing only the antennas 12, 13. Feeding points 113, 114, 115 are formed on the respective antennas 11, 12, 13, respectively.

Taking account of residual mutual inductances of the three sets of antennas 11, 12, 13 in terms of relationships between the respective two sets of antennas, the relationship between the antennas 11, 12 is represented by S1+S2=S3+S4 and is thus equivalent to the relationship between the two sets of antennas shown in FIG. 9, while the relationship between the antennas 11, 13 and the relationship between the antennas 12, 13 are represented by S5=S6 and S7=S8 and is thus equivalent to the relationship between the two sets of antennas shown in FIG. 3. Accordingly, these three sets of antennas 11, 12, 13 have residual mutual inductances of 0 and can be used as an antenna having a small remote electromagnetic-field intensity to be able to supply electricity with high efficiency. All three sets of antennas may be used as transmission and reception antennas or one of them may be used as an antenna for exclusive use in reception.

Figure 12:
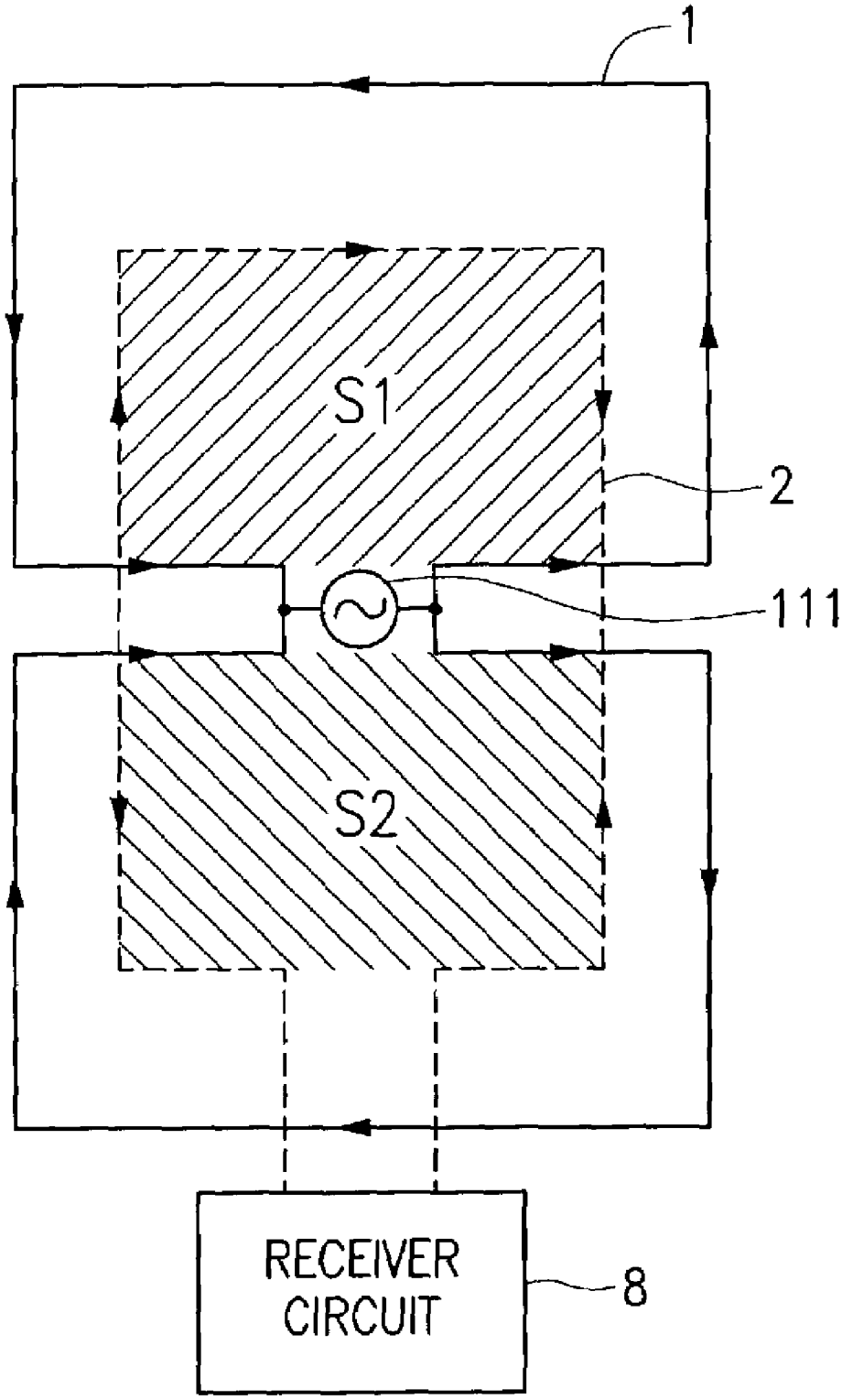
FIG. 12 is a view showing a further embodiment of a radio guidance antenna according to the invention.

FIG. 12 is a view showing a further embodiment of the radio guidance antenna according to the invention. In FIG. 12, antennas 1, 2 are constituted in the same manner as those in the radio guidance antenna shown in FIG. 3 except that the antenna 2 is not provided with any feeding point but is connected to a receiver circuit 8. Current caused by inductive coupling and electrostatic coupling flows to the antenna 2 from the antenna 1. In the present embodiment, since the antennas 1, 2 are small in degree of coupling, electric power supplied to the antenna 1 is radiated as an electromagnetic field from the antenna 1 with high efficiency. Also, the reception current generated in the antenna 2 connected to the receiver circuit 8 is not excessively absorbed by the antenna 1 but can be efficiently input into the receiver circuit 8.

Figure 13B:
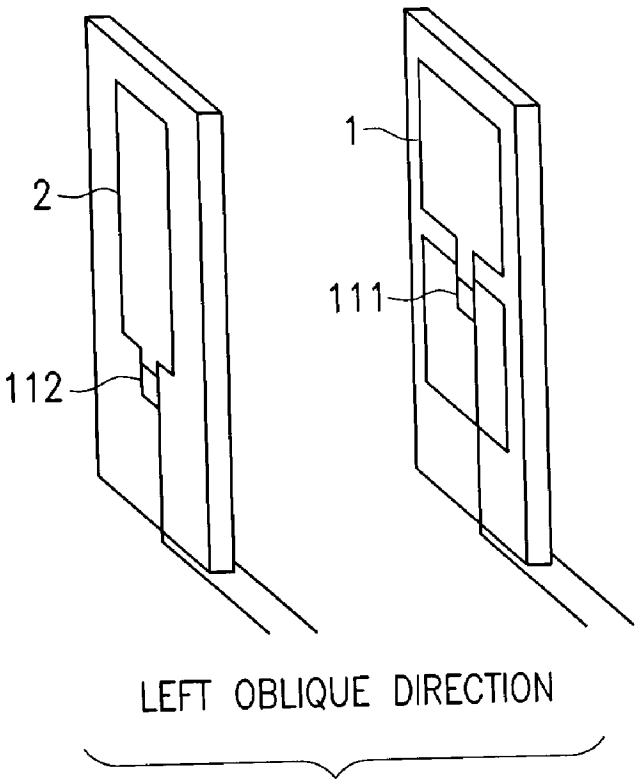
FIGS. 13A and 13B are views showing an application in which antennas are installed to face each other in a gate-like manner.
Figure 13A:
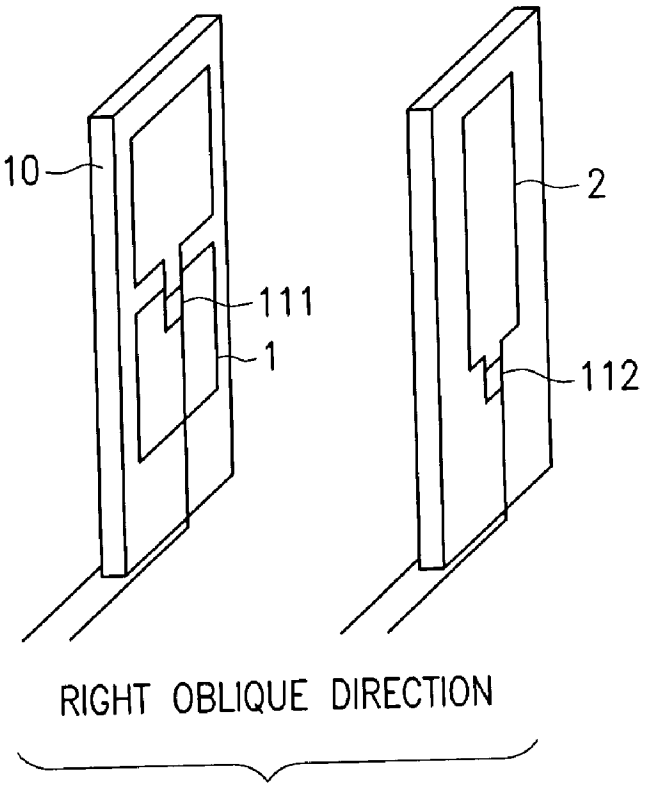

FIGS. 13A and 13B are views showing an application, in which antennas are installed to face each other in a gate-like manner. Gates on respective sides are the same in structure as that shown in FIGS. 6A to 6E, FIG. 13A being a view of the gates as viewed in a right oblique direction, and FIG. 13B being a view of the gates as viewed in a left oblique direction. A "send" signal is fed to an antenna 1 via a feeding point 111 by way of a coaxial cable, and an antenna 2 is also connected to a coaxial cable via feeding point 112. In the present embodiment, the antenna 2 can be also used for transmission and reception and as an antenna for exclusive use in reception.

In addition, the antennas 1, 2 have an impedance of around 5 Ω while the coaxial cable has an impedance of 50 Ω, so that the antennas 1, 2 and the coaxial cable are connected to the respective feeding points 111, 112 via impedance translate circuits (not shown).

Figure 14A:
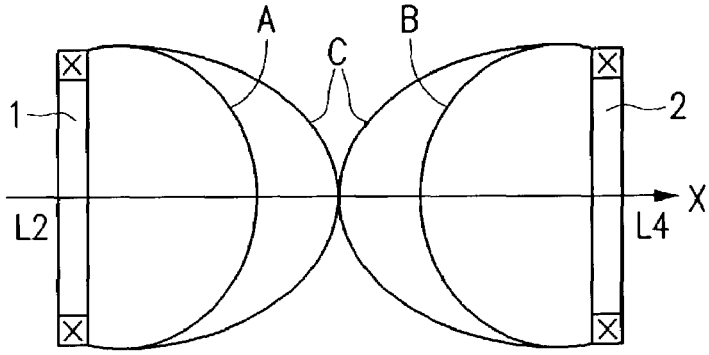
FIGS. 14A to 14C are views showing the relationship between a reception distance and the antennas in the embodiment shown in FIGS. 13A and 13B.
Figure 14B:
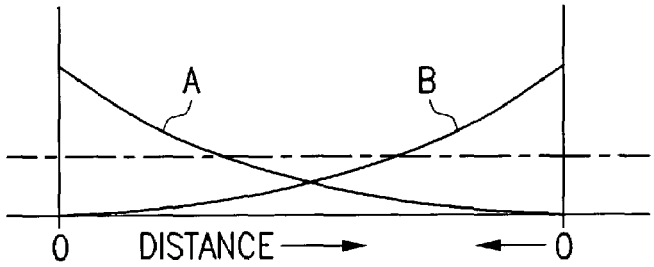
Figure 14C:
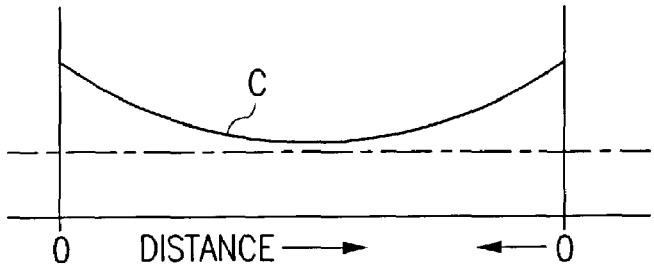

FIGS. 14A to 14C are views showing the relationship between a reception distance and the antennas 1, 2 in the embodiment shown in FIGS. 13A and 13B. Assuming that a magnetic field distribution from the antenna 1 is denoted by A and a magnetic field distribution from the antenna 2 is denoted by B in FIG. 14A, the magnetic field distributions, shown in FIG. 14B, from the antennas 1, 2 are composed as shown in FIG. 14C to enable stabilization in communication.

Figure 15A:
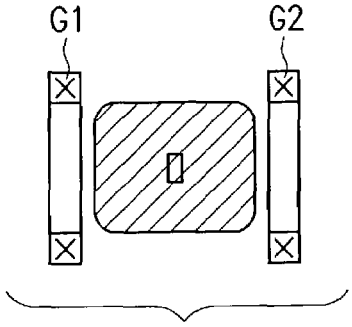
FIGS. 15A to 15E are views showing examples of an arrangement of gates G1, G2 composed of two antennas shown in FIGS. 13A and 13B.
Figure 15B:
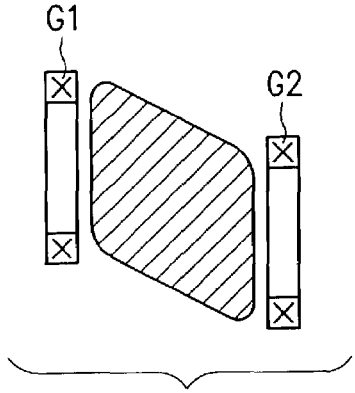
Figure 15C:
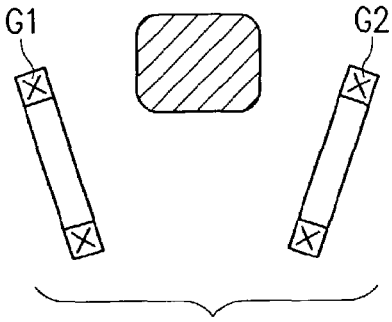
Figure 15D:
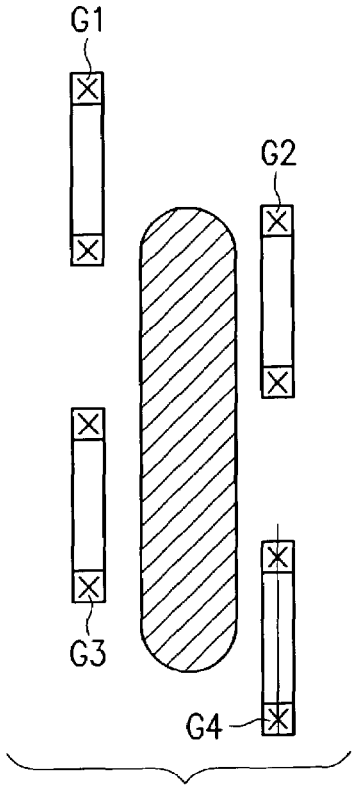
Figure 15E:
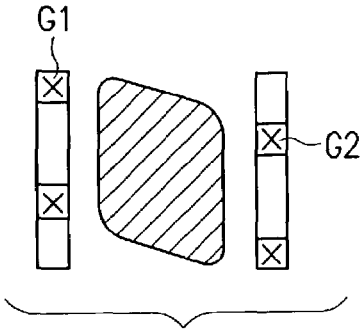

FIGS. 15A to 15E are views showing examples of an arrangement of gates G1, G2 composed of two antennas 1, 2. FIG. 15A shows that the two gates G1, G2 are arranged in parallel, and FIG. 15B shows that the two gates G1, G2 are arranged in opposition to each other and with their center distances offset. FIG. 15C shows that a pair of the gates G1, G2 are arranged obliquely relative to a parallel state, and FIG. 15D shows that a multiplicity of gates G1 to G4 are alternately arranged so that an elongate hatched region between the gates is capable of communication. Such gate construction can be expected to be applied in a wide field such as shop lifting prevention, security, management of material distribution or the like. Also, even if the arrangement shown in FIG. 15E is the same as that shown in FIG. 15B except that the gates are extended to true up both ends thereof, the essence of the invention is not impaired.

Figure 16B:
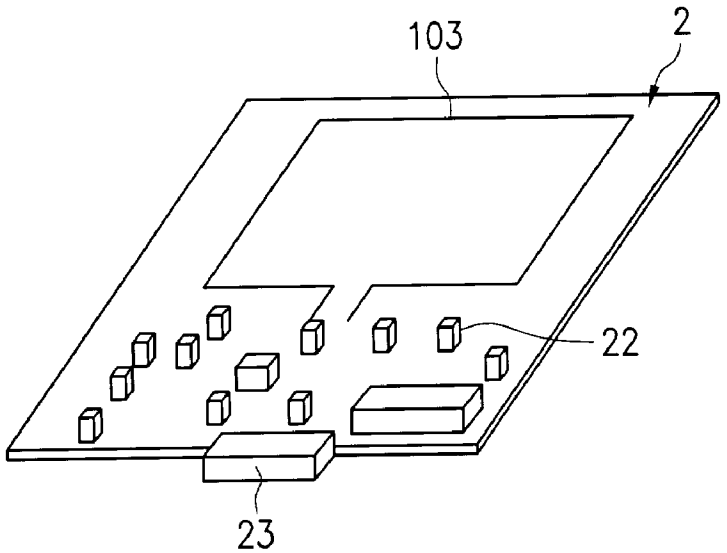
FIGS. 16A and 16B are views showing a preferred embodiment of a radio guidance antenna according to the invention.
Figure 16A:
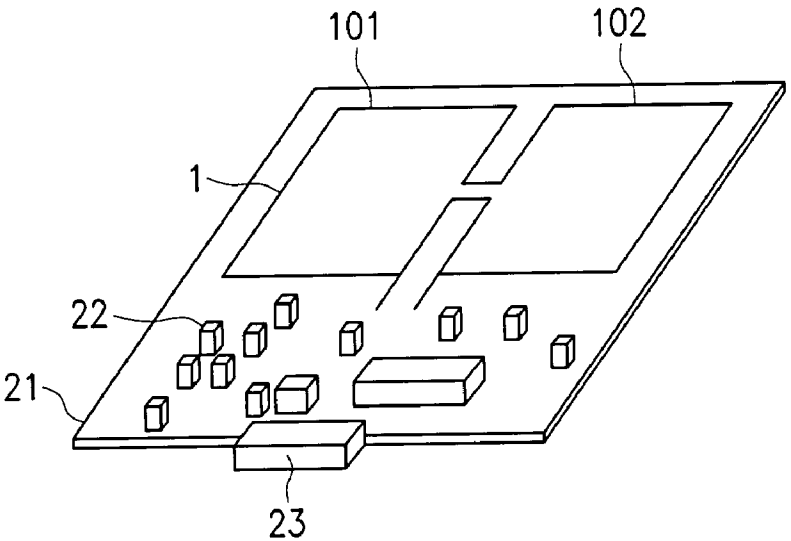

FIGS. 16A and 16B are views showing a preferred embodiment of the radio guidance antenna according to the invention, FIG. 16A being a view as viewed from above, and FIG. 16B being a view as viewed from a rear side. As shown in FIG. 16A, antenna conductors 101, 102 are used to form an antenna 1 on a surface of an insulation such as a printed board 21, to which electronic parts 22 and a connector 23 are mounted. As shown in FIG. 16B, an antenna conductor 103 is used to form an antenna 2 on a rear surface of the printed board 21, to which electronic parts 22 are mounted. These electronic parts 22 and connector 23 constitute the controller 3 and the antenna peripheral circuit 4 shown in FIG. 1, which can be made integral with the antennas 1, 2.

The substrate used in the present invention is not limited to the printed board 21 but can be formed of an insulating film and an insulating material, on which a metallic paste is applied to provide an equivalent function to that of the board. As seen from FIGS. 16A and 16B, a radio guidance antenna is used to constitute a communication system, thereby enabling a small-sized, lightweight communication system of high performance.

Figure 17:
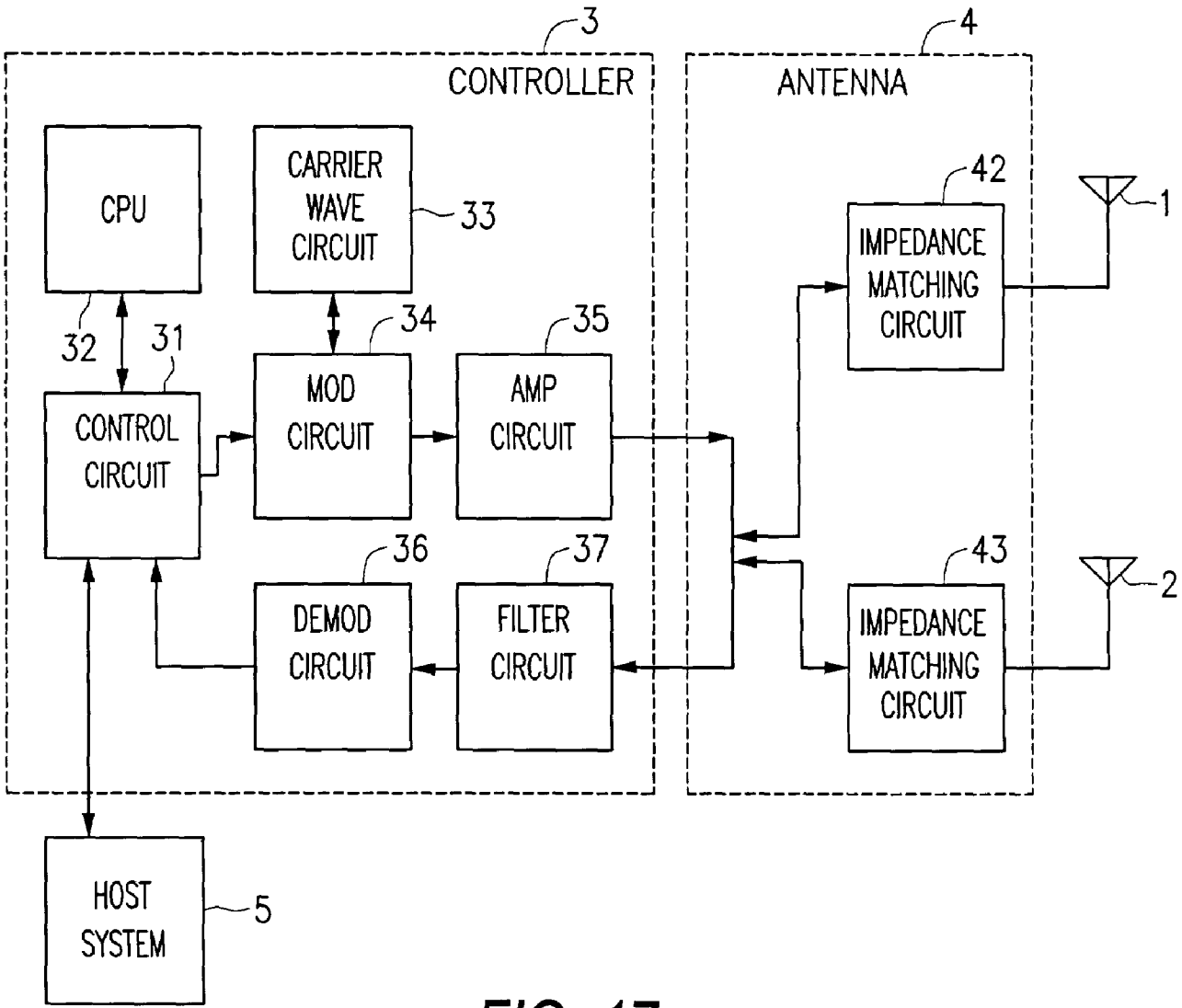
FIG. 17 is a block diagram showing a communication system, in which transmission signals are fed to both two antennas at the same time.

FIG. 17 is a block diagram showing a communication system, in which transmission signals are fed to both two antennas at the same time. In FIG. 17, the antenna select circuit 41 of the antenna peripheral circuit 4 shown in FIG. 1 is omitted, and impedance matching circuits 42, 43 are connected directly to the controller 3. Accordingly, transmission signals are fed to both the antennas 1, 2 via the impedance matching circuits 42, 43 through the controller 3 at the same time, and reception signals from both the antennas 1, 2 are fed to the controller 3. Thereby, both the antennas 1, 2 are used as antennas for transmission and reception.

Figure 18:
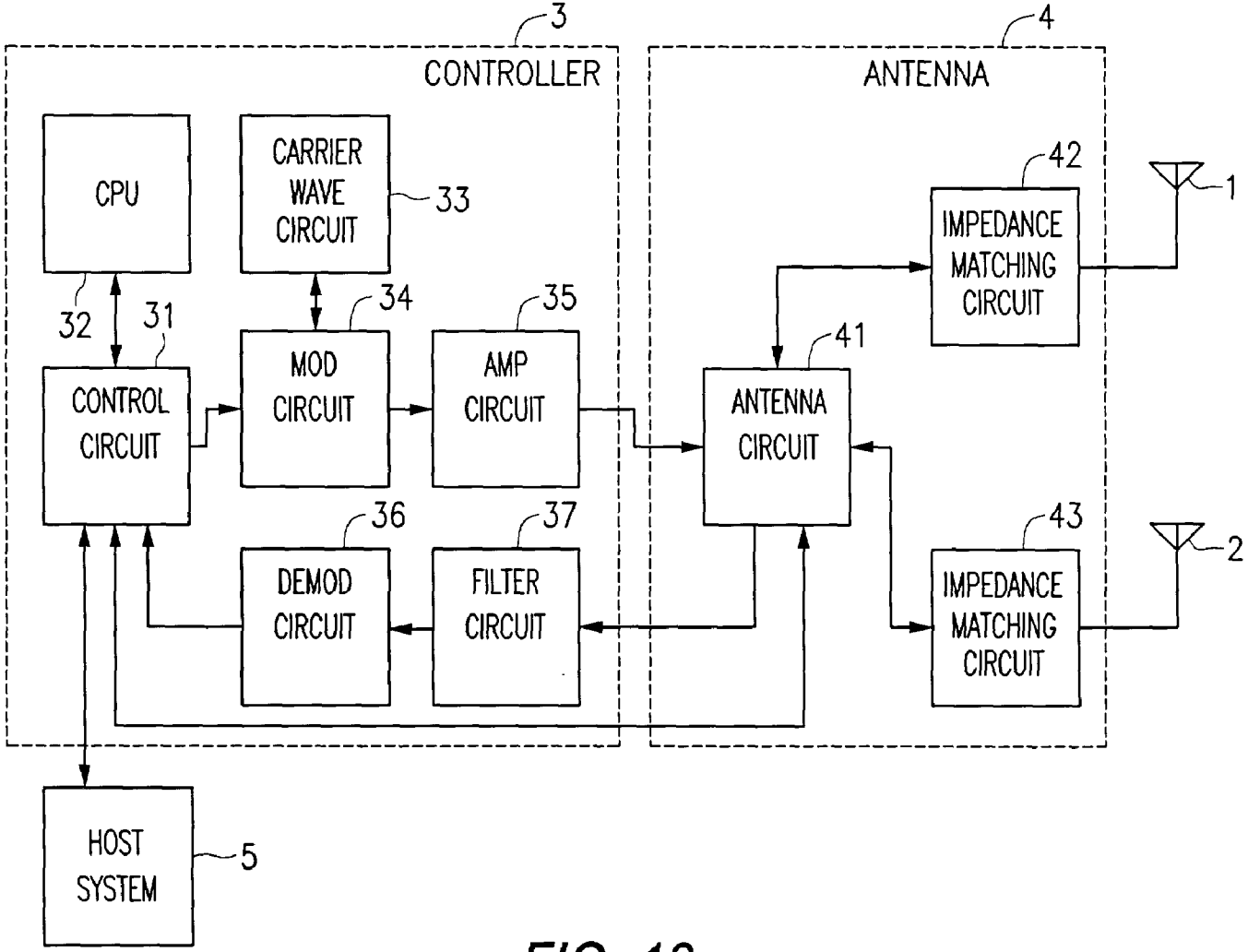
FIG. 18 is a view showing a further embodiment of a communication system with a radio guidance antenna.

FIG. 18 is a view showing a further embodiment of a communication system with a radio guidance antenna. In FIG. 18, a transmission signal is fed only to an antenna selected by the antenna select circuit 41, and a reception signal only from the selected antenna is made effective. Therefore, control signals are added between the control circuit 31 and the antenna select circuit 41 while otherwise the system is the same as that shown in FIG. 1. Thereby, both the antennas 1, 2 can be used as antennas for transmission and reception.

Figure 19:
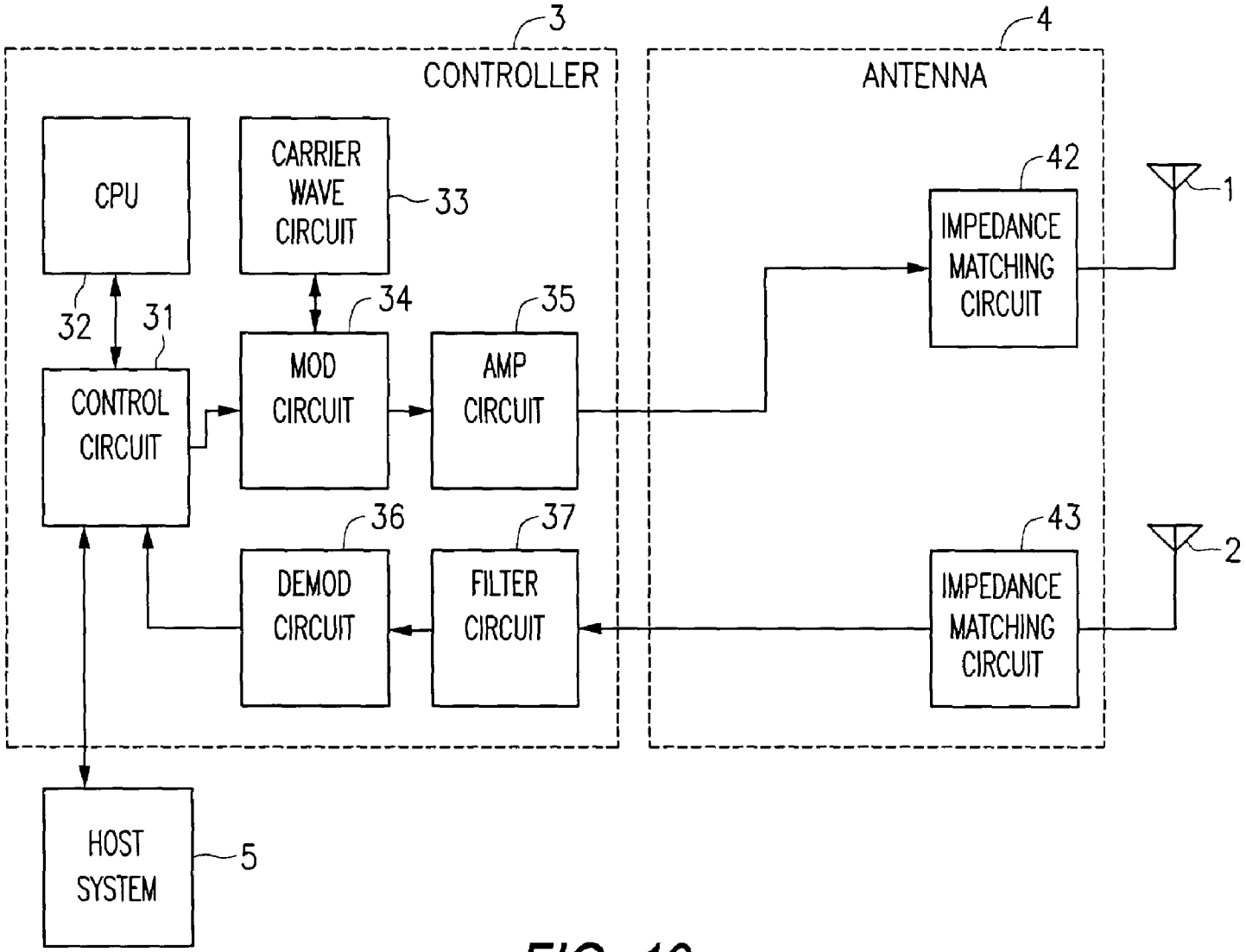
FIG. 19 is a block diagram showing a still further embodiment of a communication system with a radio guidance antenna.

FIG. 19 is a block diagram showing a still further embodiment of a communication system with a radio guidance antenna. In the embodiment shown in FIG. 19, a transmission signal is fed only to antenna 1 and a reception signal is fed only from antenna 2, such that antenna 1 is used exclusively for transmission and antenna 2 is used exclusively for reception. Therefore, the output of the amplifier circuit 35 of the controller 3 is connected to the impedance matching circuit 42 of the antenna peripheral circuit 4, and the output of the impedance matching circuit 43 is connected to the filter circuit 37 of the controller 3.

Figure 20C:
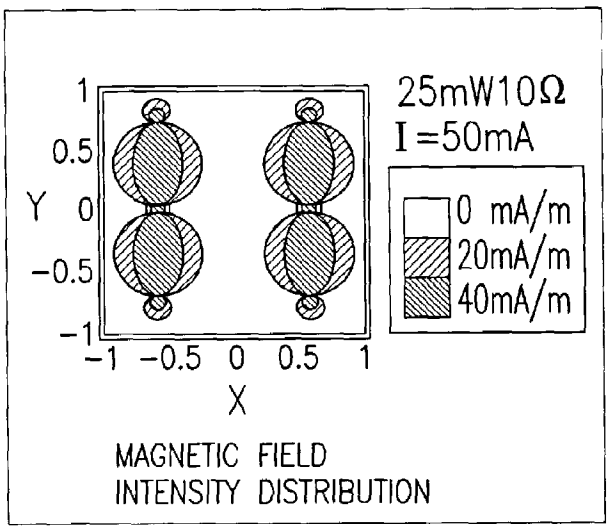
FIGS. 20A to 20C are views showing examinations of an effect provided by the embodiment of the invention through calculation of electromagnetic-field intensity.
Figure 20B:
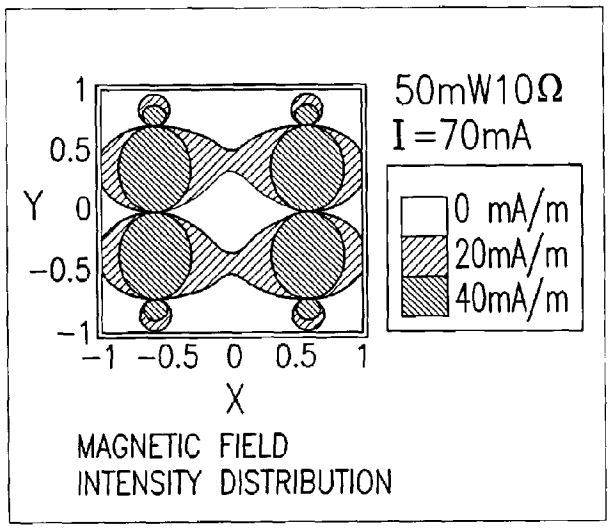
Figure 20A:
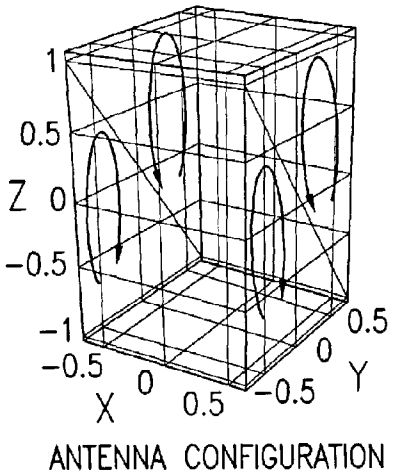
Figure 21:
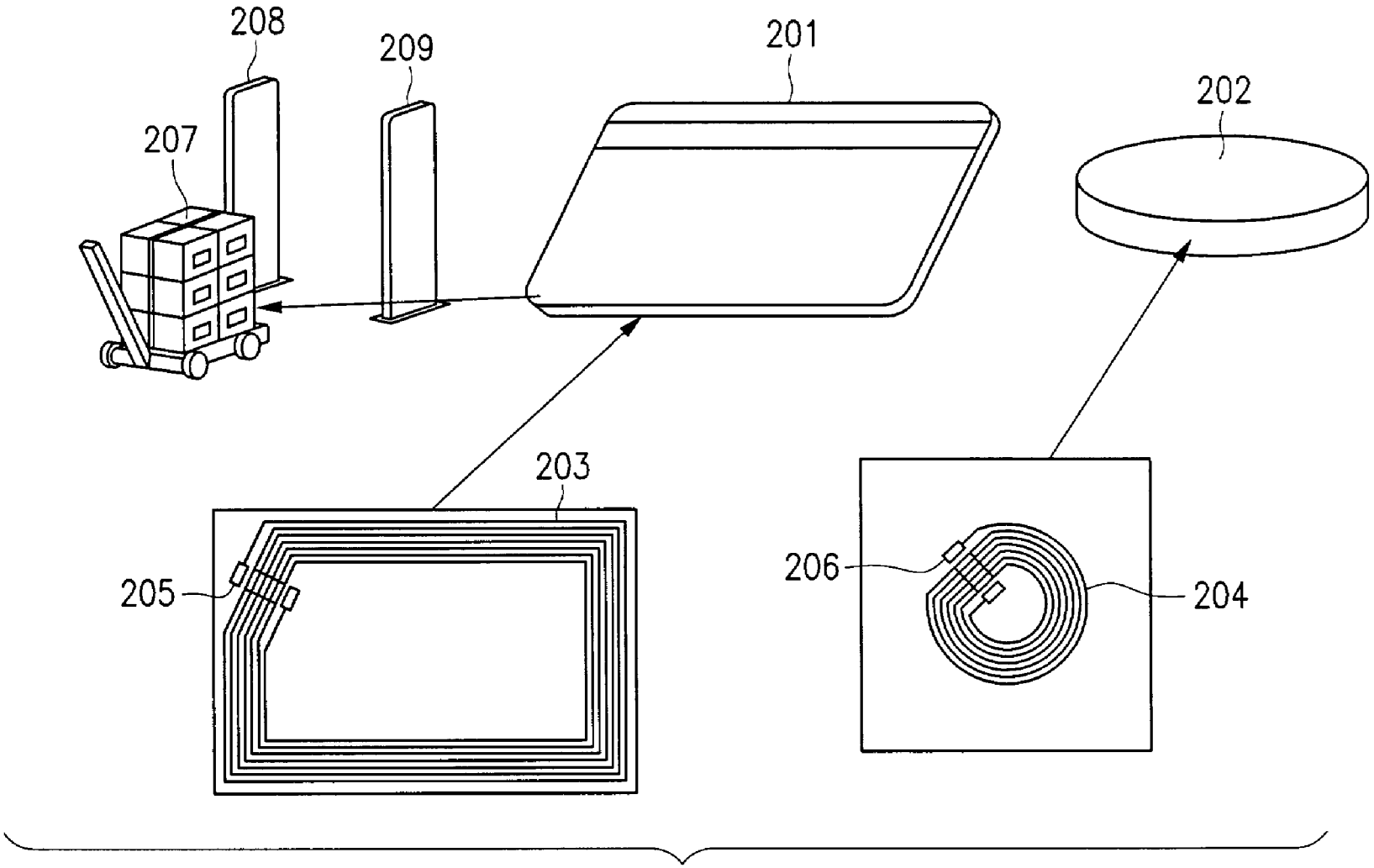
FIG. 21 is a view showing the schematic constitution of a system for identification and management of articles.
Figure 22:
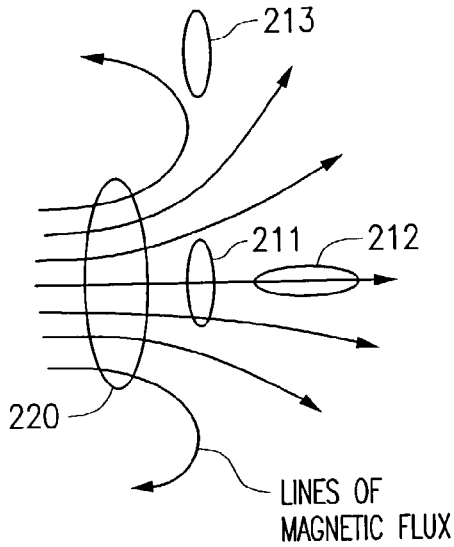
FIG. 22 is a view showing mutual inductance between a transmission loop antenna of one winding and loop antennas on a side of tags.
Figure 23:
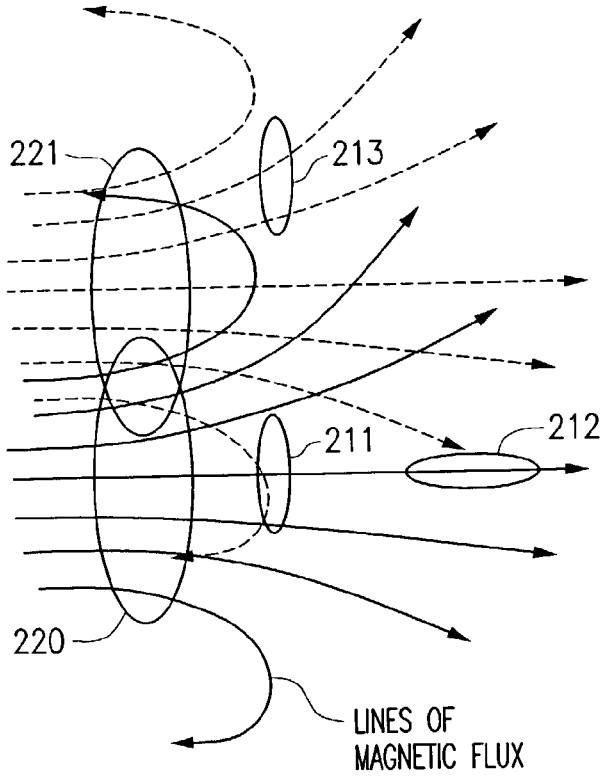
FIG. 23 is a view showing mutual inductance between transmission loop antennas when there are provided two transmission antennas.

FIGS. 20A to 20C show examinations of an effect provided by the embodiment of the invention through calculation of electromagnetic-field intensity. FIG. 20A shows a configuration of a transmission antenna used in the examination. Substantially figure eight-shaped antennas indicated by thick lines are arranged on respective surfaces which face each other in a substantially portal-shaped manner, and have a similar configuration to the antenna 1 shown in the respective embodiments. Also, arrows shown inside the antennas indicate a direction of current at a certain point in time.

The magnetic-field intensity distribution shown in FIG. 20B illustrates components in a X-direction obtained by calculating a magnetic-field intensity distribution at a plane Z=0 when the signal electric power of 50 mW of a phase difference of 0° is fed to each of the substantially figure eight-shaped antennas with the conductor resistance value of the transmission antenna being 10 Ω.

Here, tags used in non-contact data communication apparatuses are capable of communication only when entering a region having generated a signal magnetic field of a constant intensity, and a minimum value of a magnetic-field intensity capable of communication is varied depending upon a configuration of a tag. More specifically, in the case where there is a tag, in which a minimum value of a magnetic-field intensity capable of communication is known, a curve drawn by a minimum value of a magnetic-field intensity generated by a transmission antenna can be immediately understood as a communication enabling region of a tag placed in parallel to a YZ plane. In the case where a tag can make communication at the magnetic-field intensity of, for example, 20 mA/m, close regions (dark shaded regions+hatched regions shown in FIG. 20B) surrounded by an outermost curve surrounding the antenna are made capable of communication. Thus the magnetic-field intensity distribution shown in FIG. 20B is one in the case where all the electric power is supplied to the first antenna. At this time, the antenna current assumes 70 mA.

The magnetic-field intensity distribution in FIG. 20C illustrates the case where a single induced antenna is not formed as in the earlier embodiments of the invention, but instead a plurality of antennas are arranged. In FIG. 20C, half of the signal electric power is taken by antennas other than the first antenna and only an electric power of 25 mW is fed to the first antenna. At such a time, the antenna current measures 50 mA. Regions capable of communication are sharply reduced as compared with the case shown in FIG. 20B. Since the magnetic-field intensity is in proportion to the antenna current, components in a Y-axis direction and components in a Z-axis direction are likewise reduced and so regions capable of communication are reduced.

As described above, an intense magnetic field can be generated with the same supply of electric power. Also, since all the electric power is supplied to the substantially figure eight-shaped antenna, the current flowing to the two loops defining the 8-shape is well balanced. That is, the remote electromagnetic-field intensity is much suppressed by the figure eight-shaped antenna, thus enabling an ideal radio guidance antenna capable of lessening an effect of interfering electromagnetic waves on other equipment.

As described above, according to the invention, the first antenna has at least two regions for generating lines of magnetic flux in reciprocal directions, and the second antenna has first and second mutual inductances for generating induced electromotive forces in opposite directions due to an action of electromagnetic induction from the first antenna, the second antenna being arranged to decrease the sum of mutual inductances between it and the first antenna. Doing so enables electric power to be efficiently converted to electromagnetic field with a simple construction and a remote electromagnetic-field intensity can also be suppressed to be small, so that it is possible to realize a radio guidance antenna, which is small-sized, lightweight and excellent in quality of communication.

Also, data are sent to the tag from one of the first and second antennas with electromagnetic induction, and the other of the first and second antennas receives data sent from the tag with electromagnetic induction, whereby electric power as supplied can be efficiently converted to electromagnetic field with a radio guidance antenna and data communication is enabled in a communication area in non-contact manner even when a tag is oriented in any direction.

It is to be understood that the embodiments disclosed herein are exemplary in all respects and not limitative. It is intended that the scope of the invention is defined not by the above explanation but by the claims and contains all modifications in the meaning and scope equivalent to the claims.

What is claimed as new and desired to be protected by Letters Patent of the United States is:

1. A radio guidance antenna comprising:

first and second antennas, where the first and second antennas can be supplied with independent electric power from different feeding points, wherein the first antenna has at least two regions for generating lines of magnetic flux in reciprocal directions, and the second antenna has first (S1) and second (S2) mutual inductances for generating induced electromotive forces in opposite directions due to electromagnetic induction from the first antenna, wherein the feeding point of the first antenna is located at the center point of the first antenna, the second antenna being arranged so that the sum of mutual inductances between it and the first antenna is minimized, wherein the feeding point of the second antenna is located at the edge of the second antenna, wherein said first and second antennas are located on first and second gate structures, such that said first and second antennas are configured to face each other in a gate-like manner.

2. The radio guidance antenna according to claim 1, wherein a difference in value between the first and second mutual inductances is equal to or less than one half of a self inductance of the first antenna.

3. The radio guidance antenna according to claim 1, wherein a difference in value between the first and second mutual inductances is equal to or less than one third of a self inductance of the first antenna.

4. The radio guidance antenna according to claim 1, wherein the first antenna comprises two or more antennas.

5. The radio guidance antenna according to claim 1, wherein the first antenna is formed in a substantially figure eight shape in order to generate lines of magnetic flux in reciprocal directions.

6. The radio guidance antenna according to claim 5, wherein the second antenna is formed in a substantially figure eight shape and arranged in a position turned 90 degrees relative to the first antenna.

7. The radio guidance antenna of claim 1, wherein S1 is approximately equal to S2.

8. The radio guidance antenna of claim 1, wherein said second antenna is configured for transmitting and receiving signals.

9. The radio guidance antenna of claim 1, wherein said second antenna is configured exclusively for receiving signals.

10. The radio guidance antenna of claim 1, further comprising:

a first communication cable coupled to the feeding point of the first antenna; and a second communication cable coupled to the feeding point of the second antenna.

11. The radio guidance antenna of claim 1, wherein said first gate structure is substantially parallel to said second gate structure.

12. The radio guidance antenna of claim 11, wherein a center of said first gate structure is offset from a center of said second gate structure.

13. A method for data communication with an electronic tag in a non-contact manner using electromagnetic induction, comprising:

providing a radio guidance antenna including a first antenna having at least two regions for generating lines of magnetic flux in reciprocal directions and a second antenna having first and second mutual inductances for generating induced electromotive forces in opposite directions due to an action of electromagnetic induction from the first antenna;

arranging the first and second antennas so that they can be supplied with independent electric power from different feeding points;

arranging the feeding point of the first antenna to be located at the center point of the first antenna;

arranging the feeding point of the second antenna to be located at the edge of the second antenna;

arranging the second antenna so that the sum of mutual inductances between it and the first antenna is minimized; and sending data to the tag from one of the first and second antennas with electromagnetic induction, and causing the other of the first and second antennas to receive data sent from the tag using electromagnetic inductions, wherein said first and second antennas are located on first and second gate structures, such that said first and second antennas are configured to face each other.

14. The radio guidance antenna of claim 13, wherein said first gate structure is substantially oblique relative to a parallel arrangement to said second gate structure.

15. The non-contact data communication apparatus of claim 14, wherein a center of said first gate structure is offset from a center of said second gate structure.

16. A non-contact data communication apparatus for data communication with a tag in non-contact manner using electromagnetic induction, comprising:

a radio guidance antenna including a first antenna having at least two regions for generating lines of magnetic flux in reciprocal directions and a second antenna having first and second mutual inductances for generating induced electromotive forces in opposite directions due to an action of electromagnetic induction from the first antenna, the second antenna being arranged so that the sum of mutual inductances between it and the first antenna is minimized, where the first and second antennas have respective feeding points that can be independently supplied with electric power, wherein the feeding point of the first antenna is located at the center point of the first antenna, wherein the feeding point of the second antenna is located at the edge of the second antenna wherein said first and second antennas are located on first and second gate structures, such that said first and second antennas are configured to face each other; and receiver means for receiving data sent to the tag from either of the first and second antennas using electromagnetic induction.

17. The non-contact data communication apparatus according to claim 16, wherein the radio guidance antenna is arranged on a substrate and the transmission means or receiver means is also arranged on the same substrate.

18. The non-contact data communication apparatus of claim 16, wherein said first gate structure is substantially oblique relative to a parallel arrangement to said second gate structure.

19. A non-contact identification apparatus, comprising:

a first antenna having at least two regions for generating lines of magnetic flux in reciprocal directions;

a second antenna having first and second mutual inductances for generating induced electromotive forces in opposite directions due to electromagnetic induction from the first antenna, the second antenna being arranged so that the sum of mutual inductances between it and the first antenna is minimized, where the first and second antennas have respective feeding points that can be independently supplied with electric power, wherein the feeding point of the first antenna is located at the center point of the first antenna, wherein the feeding point of the second antenna is located at the edge of the second antenna, wherein said first and second antennas are located on first and second gate structures, such that said first and second antennas are configured to face each other in a gate-like manner;

a controller for managing communications between said first and second antennas and a host system; and a tag having data storage capability responsive to said controller.

20. The apparatus of claim 19, wherein said controller further comprises:

a CPU; and a carrier wave generating circuit, a modulation circuit, a demodulation circuit, and an amplifier circuit, all of which are responsive to said CPU.

21. The apparatus of claim 19, wherein said tag further comprises:

a control circuit; and said first and second antennas, a storage circuit, a modulation circuit, and an impedance matching circuit, all of which are responsive to said control circuit.

22. The apparatus of claim 19, wherein said first antenna further comprises upper and lower antenna conductors combining in a figure eight shape.

23. The apparatus of claim 22, wherein said first antenna receives power through a first feeding point.

24. The apparatus of claim 19, wherein said second antenna further comprises a single antenna conductor formed in a rectangular shape and located in the same plane as said first antenna.

25. The apparatus of claim 24, wherein said second antenna receives power through a second feeding point.

26. The apparatus of claim 19, wherein the residual mutual inductance between said first and second antennas is equal to or less than one third of the self inductance of said first antenna.

27. The apparatus of claim 19, wherein the signal electric power supplied to said first antenna is approximately twice the signal electric power supplied to said second antenna.

28. The apparatus of claim 19, wherein said first antenna further comprises a plurality of upper and lower antenna conductors each separately combining to form a figure eight shape.

29. The apparatus of claim 24, wherein said second antenna receives power through a receiver circuit.

30. The apparatus of claim 23, wherein said first antenna has an impedance of approximately 5 ohms and said first feeding point is connected to a coaxial cable having an impedance of 50 ohms.

31. The apparatus of claim 25, wherein said second antenna has an impedance of approximately 5 ohms and said second feeding point is connected to a coaxial cable having an impedance of approximately 50 ohms.

32. The apparatus of claim 19, wherein said first antenna is used exclusively for transmission while said second antenna is used exclusively for reception.

33. The apparatus of claim 19, wherein said first and second antennas are used both for transmission and reception.

34. The non-contact identification apparatus of claim 19, wherein said first gate structure is substantially parallel to said second gate structure.

35. The non-contact identification apparatus of claim 34, wherein a center of said first gate structure is offset from a center of said second gate structure.

36. The non-contact identification apparatus of claim 19, wherein said first gate structure is substantially oblique relative to a parallel arrangement to said second gate structure.

37. A method of operating a non-contact identification device, comprising:

generating an induced electromagnetic force in an antenna belonging to a tag, said antenna further comprising first and second antennas having respective feeding points that can be independently supplied with electric power, wherein the feeding point of the first antenna is located at the center point of the first antenna, wherein the feeding point of the second antenna is located at the edge of the second antenna, wherein said first and second antennas are located on first and second gate structures, such that said first and second antennas are configured to face each other in a gate-like manner;

providing electric power independently to said feeding points of said first and second antenna;

relaying said electromagnetic force to a demodulator circuit through an impedance matching circuit;

demodulating said electromagnetic force;

decoding a data signal resulting from said demodulating; and storing data from within said data signal into a storage circuit.

38. The method of claim 37, wherein said first gate structure is substantially parallel to said second gate structure.

* * * * *